US007011060B2

(12) United States Patent
Okamoto et al.

(10) Patent No.: US 7,011,060 B2
(45) Date of Patent: Mar. 14, 2006

(54) VALVE TIMING CONTROL APPARATUS FOR INTERNAL COMBUSTION ENGINE AND CONTROL METHOD THEREOF

(75) Inventors: Naoki Okamoto, Isesaki (JP); Masahiko Watanabe, Atsugi (JP); Yoshiyuki Kobayashi, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/083,319

(22) Filed: Mar. 18, 2005

(65) Prior Publication Data

US 2005/0205031 A1 Sep. 22, 2005

(30) Foreign Application Priority Data

Mar. 19, 2004 (JP) ..... 2004-080514
Feb. 14, 2005 (JP) ..... 2005-036150

(51) Int. Cl.
*F01L 1/02* (2006.01)

(52) U.S. Cl. ..... 123/90.31; 123/90.15; 123/90.17

(58) Field of Classification Search ..... 123/90.15, 123/90.17, 90.31
See application file for complete search history.

(56) References Cited

U.S. PATENT DOCUMENTS 6,718,922 B1 * 4/2004 Yasui ..... 123/90.17

FOREIGN PATENT DOCUMENTS

JP 2000-303865 A 10/2000

* cited by examiner

*Primary Examiner*—Thomas Denion
*Assistant Examiner*—Zelalem Eshete

(74) *Attorney, Agent, or Firm*—Foley & Lardner LLP

(57) ABSTRACT

In a structure in which an opening-and-closing timing of an intake valve and/or an exhaust valve is varied due to a rotational phase of a camshaft with respect to a crankshaft of an internal combustion engine being varied, the rotational phase is detected at each rotational period of the camshaft on the basis of a reference rotational position of the crankshaft and a reference rotational position of the camshaft which have been detected, and on the other hand, the rotational phase is detected in an arbitrary timing regardless of the rotational period of the camshaft. Further, a correction value for correcting the rotational phase detected in an arbitrary timing is learned with the rotational phase detected at each rotational period of the camshaft as a reference.

21 Claims, 26 Drawing Sheets

VALVE TIMING CONTROL APPARATUS FOR INTERNAL COMBUSTION ENGINE AND CONTROL METHOD THEREOF

BACKGROUND OF THE INVENTION

1. Field of the Invention

The present invention relates to a valve timing control apparatus for an internal combustion engine which varies a valve timing (an opening-and-closing timing) of an intake valve and/or an exhaust valve of an engine due to a rotational phase of a camshaft with respect to a crankshaft of an internal combustion engine being varied.

2. Description of the Related Art

As a valve timing control apparatus for an internal combustion engine, there is an apparatus disclosed in Japanese unexamined patent publication No. 2000-303865. In this type of conventional valve timing control apparatus for an internal combustion engine, a crank angle sensor outputting a crank angle signal at a reference rotational position of a crankshaft and a cam sensor outputting a cam signal at a reference rotational position of a camshaft are provided thereto, and a rotational phase of the camshaft with respect to the crankshaft is detected on the basis of a deviation angle between the reference rotational positions.

In the above-described conventional structure, a rotational phase is detected for each constant crank angle (rotational period of the camshaft). However, feedback control (valve timing control) based on such a detected result of a rotational phase is generally executed in each micro-unit time.

Therefore, at the time of low-speed rotating, a detection period of rotational phases is made longer than an execution period of valve timing control, and the rotational phases cannot be detected with sufficient frequency in terms of the controllability. In such a case, there is a problem that a deviation with a target rotational phase is calculated on the basis of a rotational phase different from an actual rotational phase, and a feedback manipulated variable is calculated on the basis of an incorrect deviation, and the controllability deteriorates.

Here, rotational phase detecting means which can detect a rotational phase in an arbitrary timing regardless of the rotational period of the camshaft is provided, and by carrying out detection of a rotational phase in accordance with a request such as a valve timing control period or the like, it is possible to detect a rotational phase with sufficient frequency in terms of the controllability at the time of low-speed rotating as well.

However, in a case in which a rotational phase can be detected in an arbitrary timing, usually, as compared with the above-described conventional structure, there is a high possibility that the output characteristics or the like of the rotational phase detecting means (detecting element) are varied over time, and a new problem that the precision in detecting rotational phase, i.e., the precision of a valve timing control deteriorates due to a variable (deviation) in the output characteristics is brought about.

SUMMARY OF THE INVENTION

The present invention has been achieved in consideration of the problems, and an object of the present invention is to provide rotational phase detecting means which can detect a rotational phase in an arbitrary timing, and even when the output characteristics or the like thereof has been changed, to be able to always realize high-responsive/high-accurate valve timing control even at the time of low-speed rotating by modifying the case.

In order to achieve the object, in a first invention, in a structure in which an opening-and-closing timing of an intake valve and/or an exhaust valve is varied due to a rotational phase of a camshaft with respect to a crankshaft being varied, a correction value for correcting a second rotational phase of detected in an arbitrary timing is learned regardless of the rotational period of the camshaft, with a first rotational phase detected for each rotational period of the camshaft being as a reference, on the basis of output signals of a crank angle sensor detecting a reference rotational position of the crankshaft and a cam sensor detecting a reference rotational position of the camshaft.

Here, in order to carry out the stable learning (calculation of a correction value), the learning of correction value is preferably carried out when a variation per a predetermined time in at least one of the first rotational phase and the second rotational phase which have been detected is less than or equal to a predetermined amount (i.e., when it is substantially constant).

Further, the learning of correction value is preferably carried out when an engine temperature is within a predetermined range in consideration of the temperature characteristic of a sensor detecting the second rotational phase or the like.

The other objects and features of this invention will become understood from the following description with accompanying drawings.

BRIEF EXPLANATION OF THE DRAWINGS

FIG. 10 are schematic diagrams in which FIG. 9 is developed in a linear shape, and FIG. 10A shows a flow of a magnetic flux in an initial state, and FIG. 10B shows a flow of a magnetic flux when a hysteresis ring rotates.

DETAILED DESCRIPTION OF THE EMBODIMENT

Figure 1:
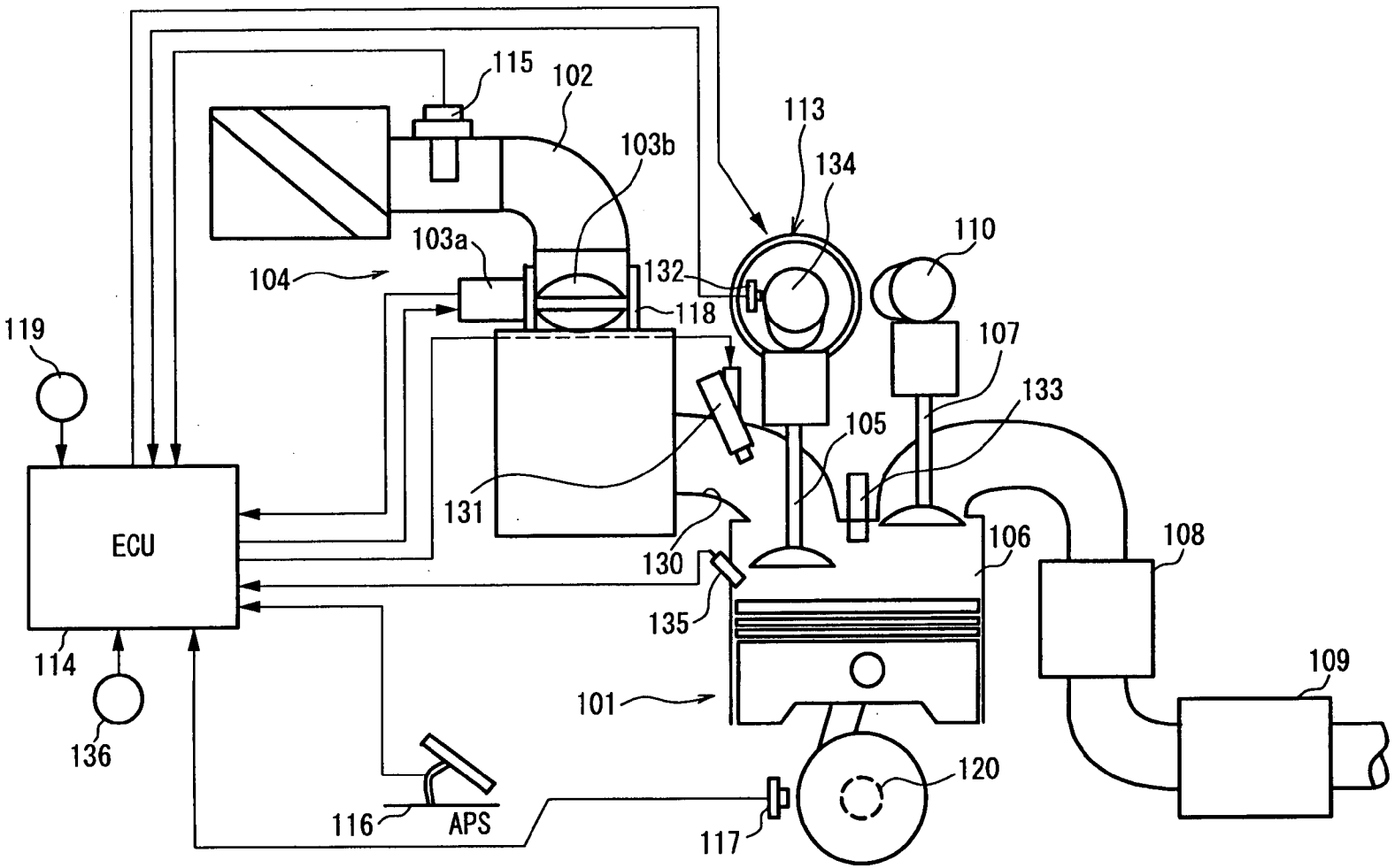
FIG. 1 is a system diagram of an internal combustion engine relating to an embodiment of the present invention.

Hereinafter, embodiments of the present invention will be described with reference to the drawings. FIG. 1 is a diagram of an internal combustion engine on vehicle in an embodiment. In FIG. 1, an electronic control throttle 104 is set at an intake pipe 102 of an internal combustion engine 101. Electronic control throttle 104 is a device controlling to open and close a throttle valve 103*b* by a throttle motor 103*a*. Then, air is sucked into a combustion chamber 106 of engine 101 via electronic control throttle 104 and an intake valve 105.

An ignition plug 133 is provided at each chamber of the engine, and spark ignition is carried out thereby, and air-fuel mixture is ignited and burnt. Exhaust gas is exhausted from combustion chamber 106 via an exhaust valve 107, and thereafter, the exhaust gas is purged through a front catalytic converter 108 and a rear catalytic converter 109, and the gas is discharged in the atmosphere.

Intake valve 105 and exhaust valve 107 are respectively controlled to open and close by cams which are provided at an intake side cam shaft 134 and an exhaust side camshaft 110. A variable valve timing mechanism (VTC) 113 is provided at intake side cam shaft 134.

VTC 113 is a mechanism is a mechanism which varies an opening-and-closing timing of intake valve 105 (a valve timing) by varying a rotational phase of intake side camshaft 134 with respect to a crankshaft 120, and the details thereof will be described later.

Note that the present embodiment is structured such that VTC 113 is provided only at the side of intake valve 105. However, it may be a structure in which VTC 113 is provided at the side of exhaust valve 107, in spite of the side of intake valve 105 or in addition to the side of intake valve 105.

Note that an electromagnetic fuel injection valve 131 is provided at an intake port 130 in each cylinder, and fuel injection valve 131 is controlled to open the valve by an injection pulse signal from an engine control unit (ECU) 114, and jets out fuel adjusted to have a predetermined pressure to intake valve 105.

Output signals from various sensors are inputted to ECU 114 in which a microcomputer is built-in, and controls electronic control throttle 104, VTC 113, ignition plug 133 and fuel injection valve 131 by computing processing based on those signals.

As the various sensors, an accelerator pedal sensor APS 116 which detects an opening of an accelerator, an air flow meter 115 detecting an intake air quantity Qa of engine 101, a crank angle sensor 117 which takes a reference crank angle signal REF at a reference rotational position at each crank angle of 180 degrees, and takes a unit angle signal POS at each unit crank angle out of crankshaft 120, a throttle sensor 118 detecting an opening TVO of throttle valve 103*b*, a water temperature sensor 119 detecting a cooling water temperature Tw in engine 101, a cam sensor 132 taking a cam signal CAM at a reference rotational position at each cam angle of 90 degrees (a crank angle of 180 degrees) out of intake side cam shaft 134, a pressure sensor 135 which detects a combustion pressure in chamber 106, a voltage sensor 136 which detects a battery voltage Vb, or the like are provided. Note that an engine rotational speed Ne is calculated on the basis of a period of the reference crank angle signal REF or a number of generating unit angle signals POS per unit time.

Next, the structure of VTC mechanism 113 will be described with reference to FIG. 2 to FIG. 14.

Figure 2:
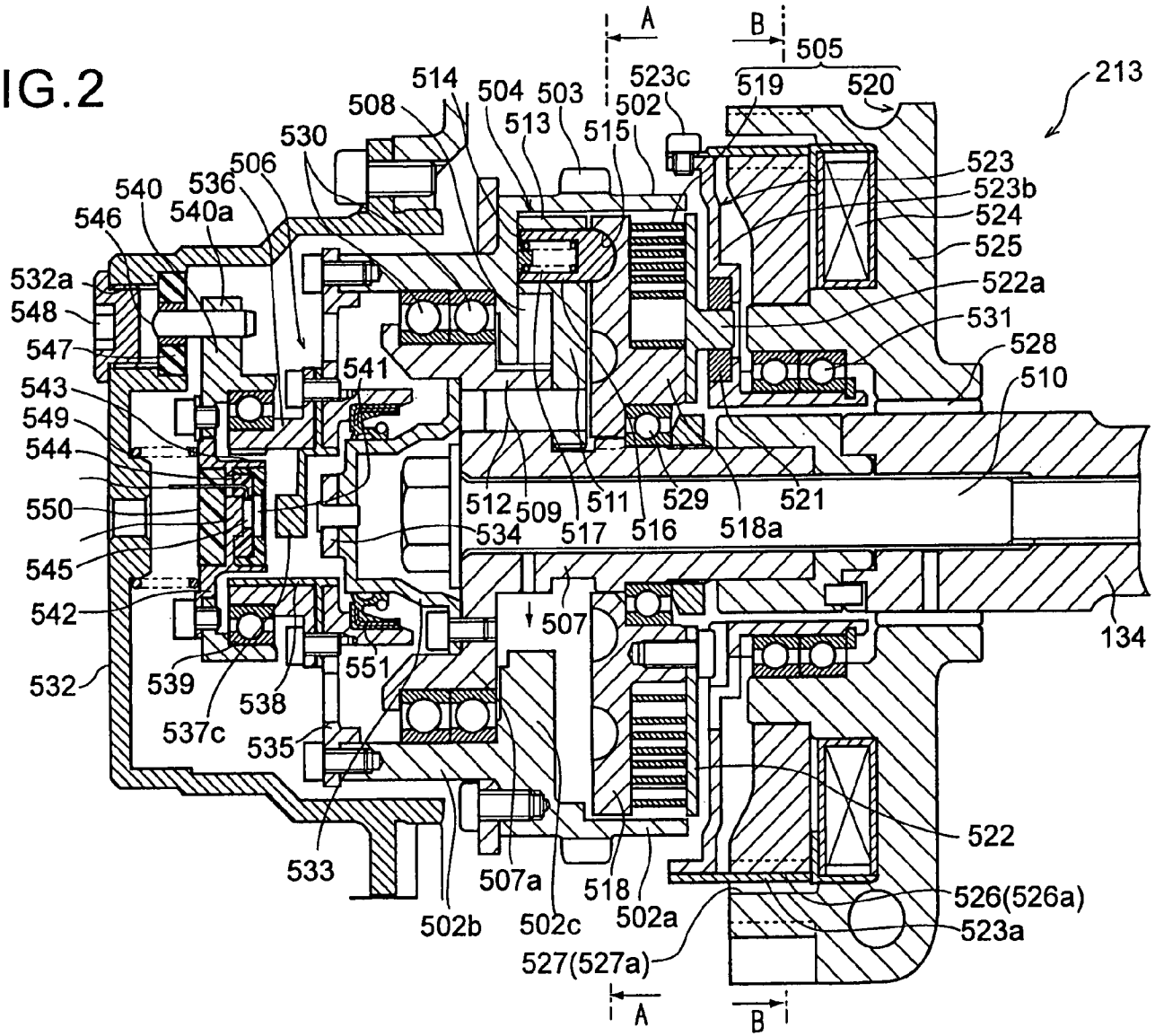
FIG. 2 is a sectional view showing a variable valve timing mechanism (VTC) relating to the embodiment.

As shown in FIG. 2, VTC mechanism 113 has a timing sprocket 502 which is assembled into the front end portion of camshaft 134 so as to be relatively rotatable, and which is made to link with crankshaft 120 via a timing chain (not shown), an assembling angle operating mechanism 504 which is disposed at an inner peripheral side of timing sprocket 502, and operates an assembling angle between timing sprocket 502 and camshaft 134, operating force providing means 505 which is disposed at the rear side which is closer to camshaft 134 than assembling angle operating mechanism 504, and which drives assembling angle operating mechanism 504, relative displacement detecting means 506 detecting an angle of relative rotational displacement (a rotational phase) of camshaft 13 with respect to timing sprocket 502, and a VTC cover 532 which is mounted on a cylinder head cover of the cylinder head, and which covers the front surfaces of assembling angle operating mechanism 504 and relative displacement detecting means 506.

In VTC 113, a driven shaft member 507 is fixed to the end portion of camshaft 134 by a cam bolt 510.

A flange 507*a* is provided so as to be integrated with driven shaft member 507.

Timing sprocket 502 is structured from a large-diameter cylinder portion 502*a* at which a gear portion 503 with which the timing chain is engaged is formed, a small-diameter cylinder portion 502*b*, and a disk portion 502*c* connecting between cylinder portion 502*a* and cylinder portion 502*b*.

Cylinder portion 502*b* is assembled so as to be rotatable by a ball bearing 530 with respect to flange 507*a* of driven shaft member 507.

Figure 3:
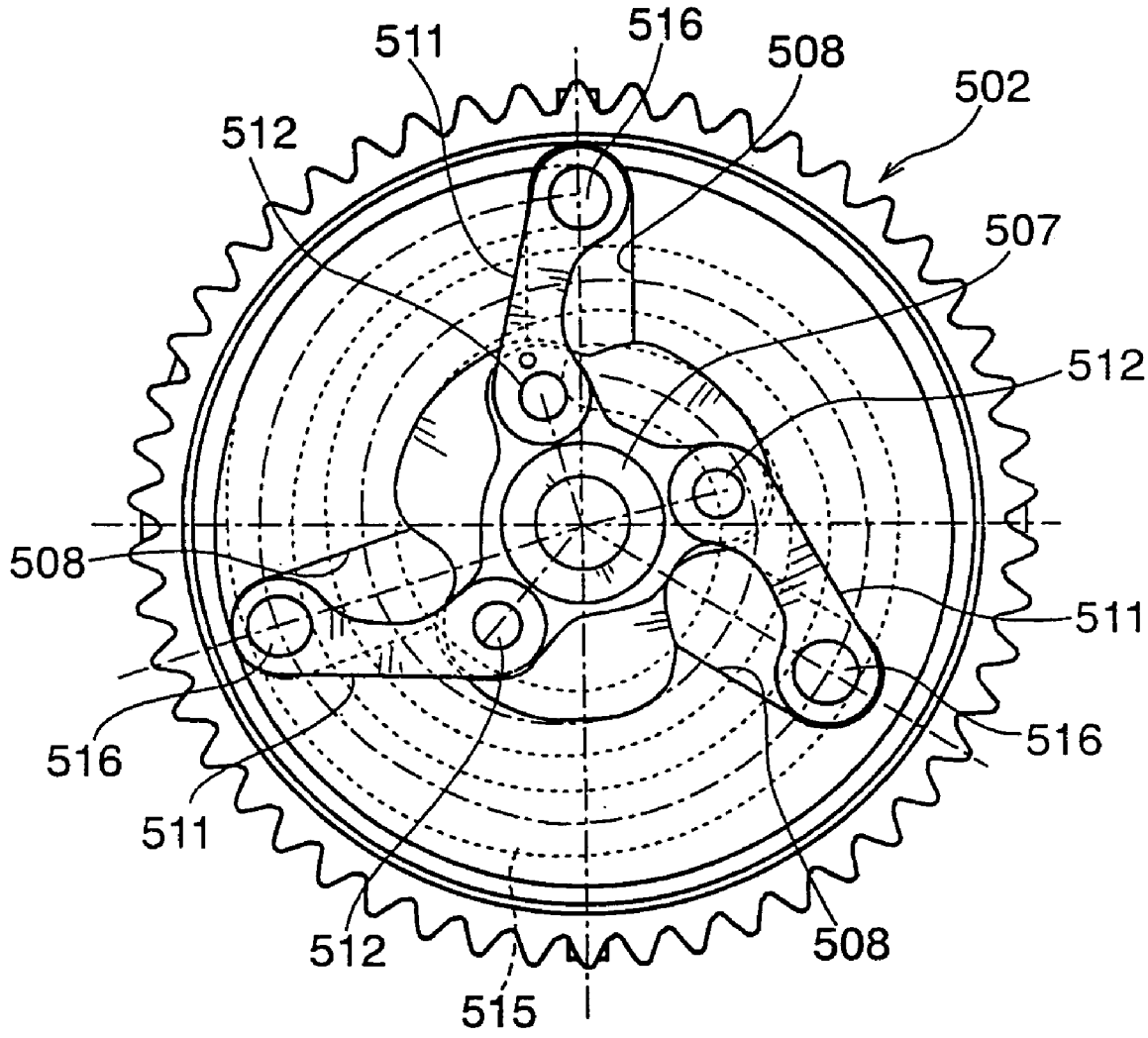
FIG. 3 is a diagram showing the VTC in a state of the maximum retard.
Figure 4:
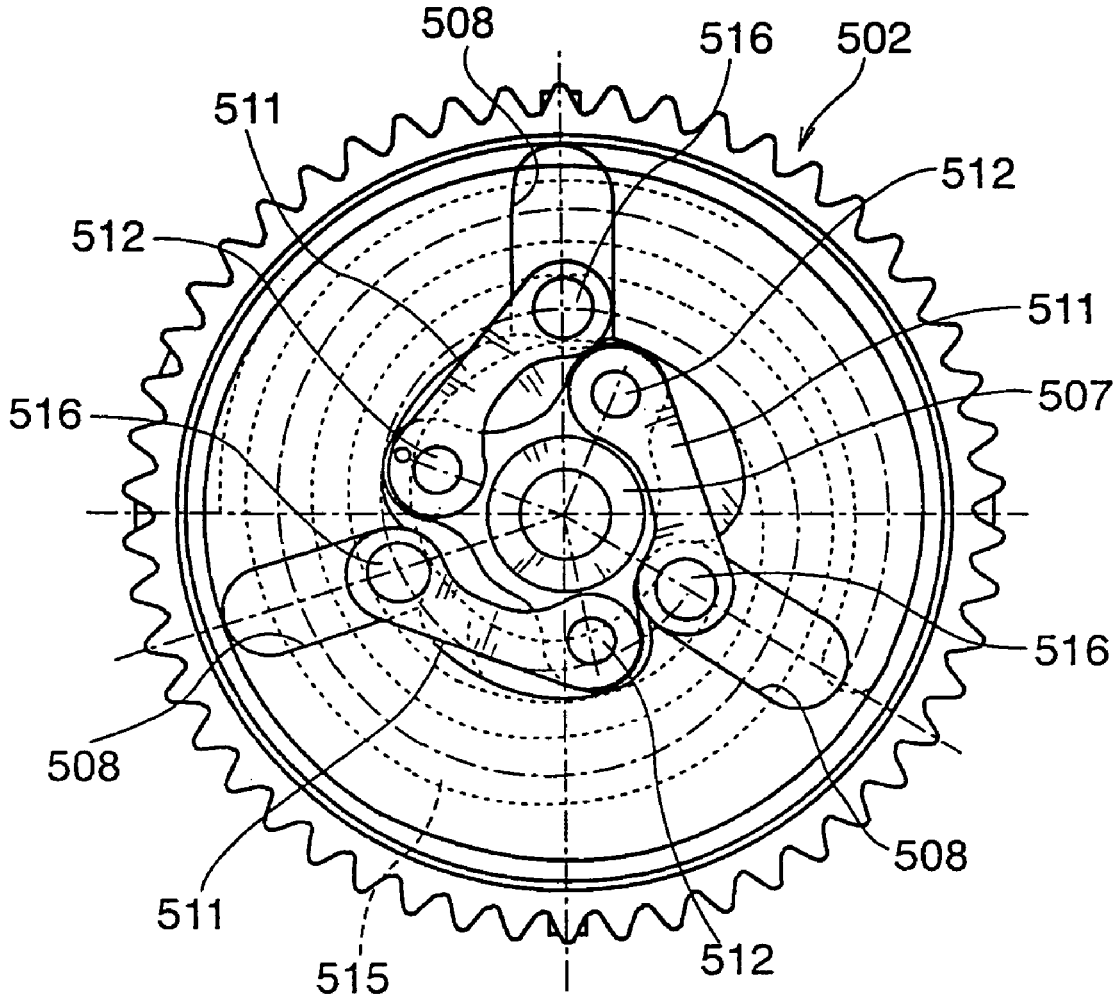
FIG. 4 is a diagram showing the VTC in a state of the maximum advance.
Figure 5:
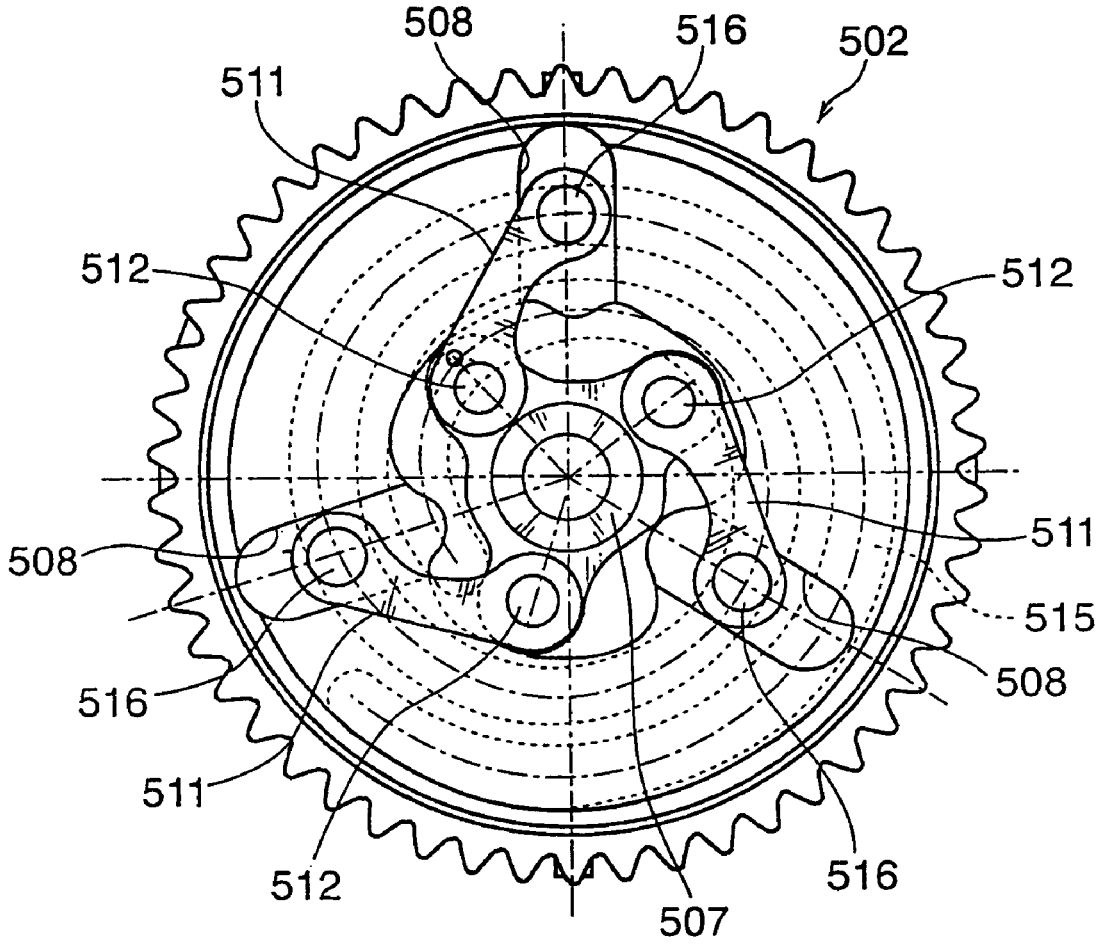
FIG. 5 is a diagram showing the VrC in a state of the intermediate advance.

As shown in FIG. 3 to FIG. 5 (corresponding to the cross-section taken along A—A of FIG. 2), three grooves 508 are formed in a radial pattern along radial directions of timing sprocket 502 at the surface at the side of cylinder portion 502*b* of the disk portion 502*c*.

Further, three protruding portions 509 protruding in a radial pattern in radial directions are formed so as to be integrated with the camshaft 134 side end surface of flange portion 507*a* of driven shaft member 507.

The base ends of three links 511 are respectively connected to respective protruding portions 509 so as to be rotatable by pins 512.

Cylindrical lobes 513 engaging with the respective grooves 508 so as to be freely rockable are formed so as to be integrated with the top ends of respective links 511.

Because respective links 511 are connected to driven shaft member 507 via pins 512 in a state in which respective lobes 513 engage with the corresponding grooves 508, when the top end sides of links 511 are displaced along grooves 508 by receiving external force, timing sprocket 502 and driven shaft member 507 are relatively rotated by the effects of respective links 511.

Further, accommodating holes 514 opening toward camshaft 134 side are formed at lobes 513 of respective links 511.

An engagement pin 516 engaging with a spiral slot 515 which will be described later, and a coil spring 517 urging the engagement pin 516 against spiral slot 515 side are accommodated in the accommodating hole 514.

On the other hand, a disk type intermediate rotator 518 is supported to be freely pivotable via a bearing 529 at driven shaft member 507 which is further at camshaft 134 side than the protruding portion 509.

Spiral slot 515 is formed at the end surface (the protruding portion 509 side) of intermediate rotator 518, and engagement pins 516 at the top ends of respective links 511 are engaged with spiral slot 515.

Spiral slot 515 is formed so as to gradually reduce the diameter along the rotational direction of timing sprocket 502.

Accordingly, when intermediate rotator 518 is relatively displaced in the retard direction with respect to timing sprocket 502 in a state in which the respective engagement pins 516 engage with spiral slot 515, the top end portions of respective links 511 are moved toward the inside in the radial direction by being led by spiral slot 515 while being guided by grooves 508.

In contrast thereto, when intermediate rotator 518 is relatively displaced in the advance direction with respect to timing sprocket 502, the top end portions of respective links 511 are moved toward the outside in the radial direction.

Assembling angle operating means 504 is structured from grooves 508, links 511, lobes 513, engagement pins 516, intermediate rotator 518, spiral slot 515, and the like of timing sprocket 502.

When an operating force for rotations is inputted from operating force providing means 505 to intermediate rotator 518, the top ends of links 511 are displaced in radial directions, and the displacement is transmitted as a turning force which varies an angle of the relative displacement between timing sprocket 502 and driven shaft member 507 via links 511.

Operating force providing means 505 has a spiral spring 519 urging intermediate rotator 518 in the rotational direction of timing sprocket 502, and a hysteresis brake 520 generating braking force which rotates intermediate rotator 518 in a direction opposite to the rotational direction of timing sprocket 502.

Here, ECU 114 controls the braking force of hysteresis brake 520 in accordance with an operating state of the internal combustion engine 101, and in accordance therewith, intermediate rotator 518 can be relatively rotated with respect to timing sprocket 502 up to a position where the urging force of spiral spring 519 and the braking force of hysteresis brake 520 are made to be in balance.

Figure 6:
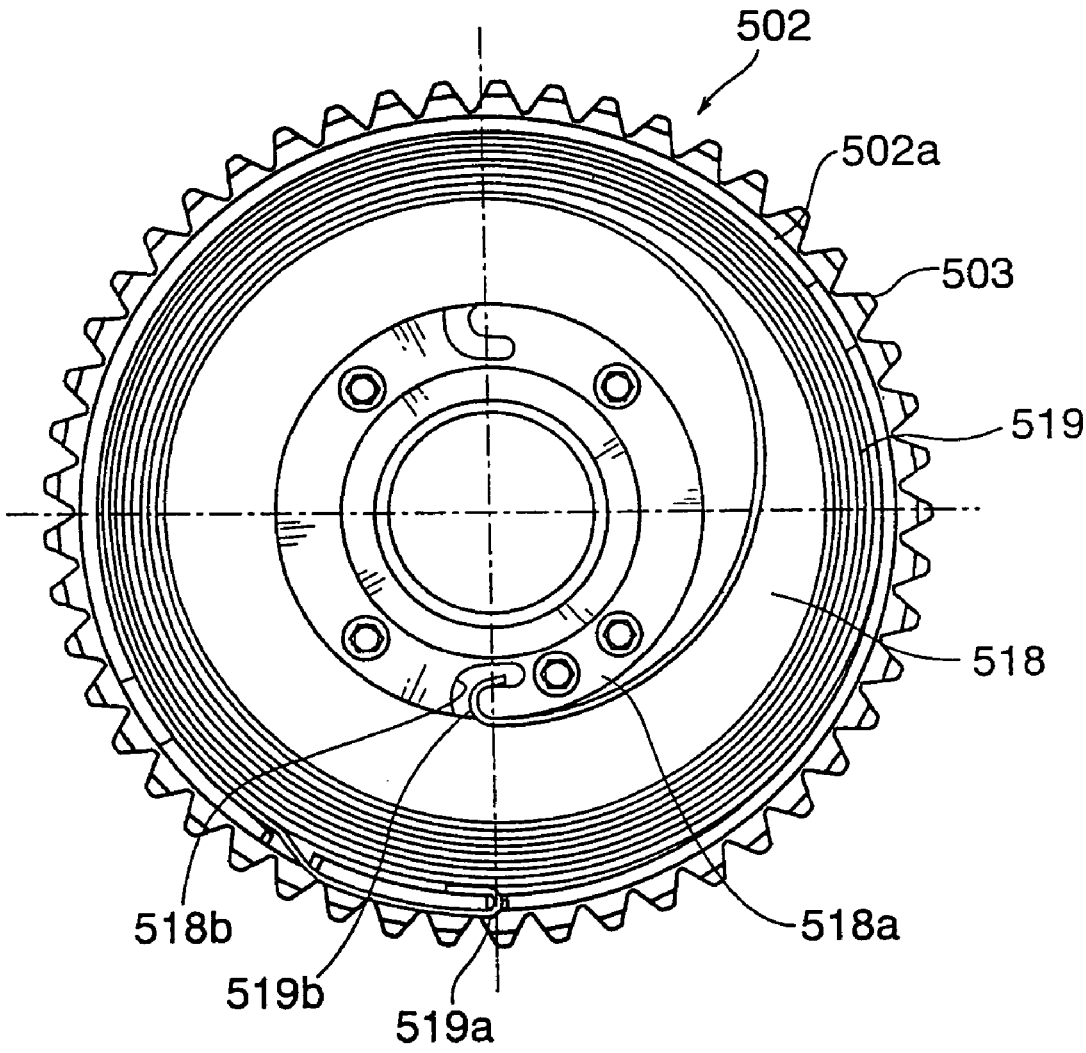
FIG. 6 is a diagram showing a state of attaching a spiral spring in the VTC.
Figure 7:
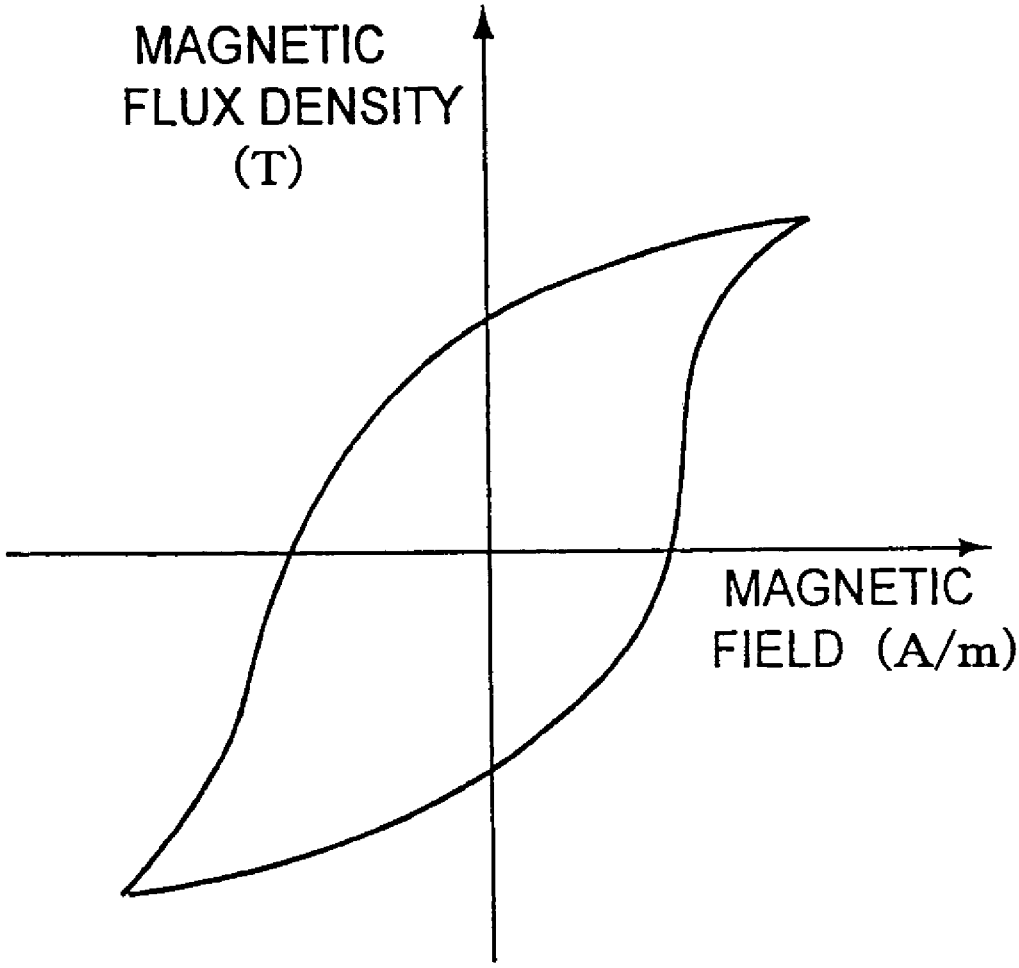
FIG. 7 is a graph showing a characteristic of a variation in a magnetic flux density of a hysteresis material.

As shown in FIG. 6, spiral spring 519 is disposed in cylinder portion 502*a* of timing sprocket 502, and an outer peripheral end portion 519*a* is engaged with the inner periphery of cylinder portion 502*a*, and an inner peripheral end portion 519*b* is engaged with an engagement slot 518*b* of a base portion 518*a* of intermediate rotator 518.

Hysteresis brake 520 has a hysteresis ring 523, an electromagnetic coil 524 serving as magnetic field control means, and a coil yoke 525 inducing magnetism of electromagnetic coil 524.

Hysteresis ring 523 is attached to the rear end portion of intermediate rotator 518 via a retainer plate 522 and a protrusion 522*a* provided so as to be integrated with the rear end surface of retainer plate 522.

Energizing (exciting current) to electromagnetic coil 524 is controlled by ECU 114 in accordance with an operating state of the engine.

Hysteresis ring 523 is structured from a cylinder portion 523*a*, and a disk type cylinder portion 523*b* to which cylinder portion 523*a* is connected by a screw 523*c*.

It is structured such that base portion 523*a* is connected to retainer plate 522 due to respective protrusions 522*a* being press-fitted into bushes 521 provided at positions at uniform intervals in the circumferential direction.

Further, hysteresis ring 523 is formed from a material having the characteristic that the magnetic flux is varied so as to have a phase delay with respect to a variation in the external magnetic field (refer to FIG. 7), and cylinder portion 523*b* receives braking effect by coil yoke 525.

Coil yoke 525 is formed so as to surround electromagnetic coil 524, and the outer peripheral surface thereof is fixed to a cylinder head out of the drawing.

Further, the side of the inner periphery of coil yoke 525 supports camshaft 134 to be freely pivotable via a needle bearing 528, and the side of base portion 523*a* of hysteresis ring 523 is supported so as to freely pivotable by a ball bearing 531.

Then, a pair of facing surfaces 526 and 527 which face one another via a ring-shaped gap are formed at the side of intermediate rotator 518 of coil yoke 525.

Figure 8:
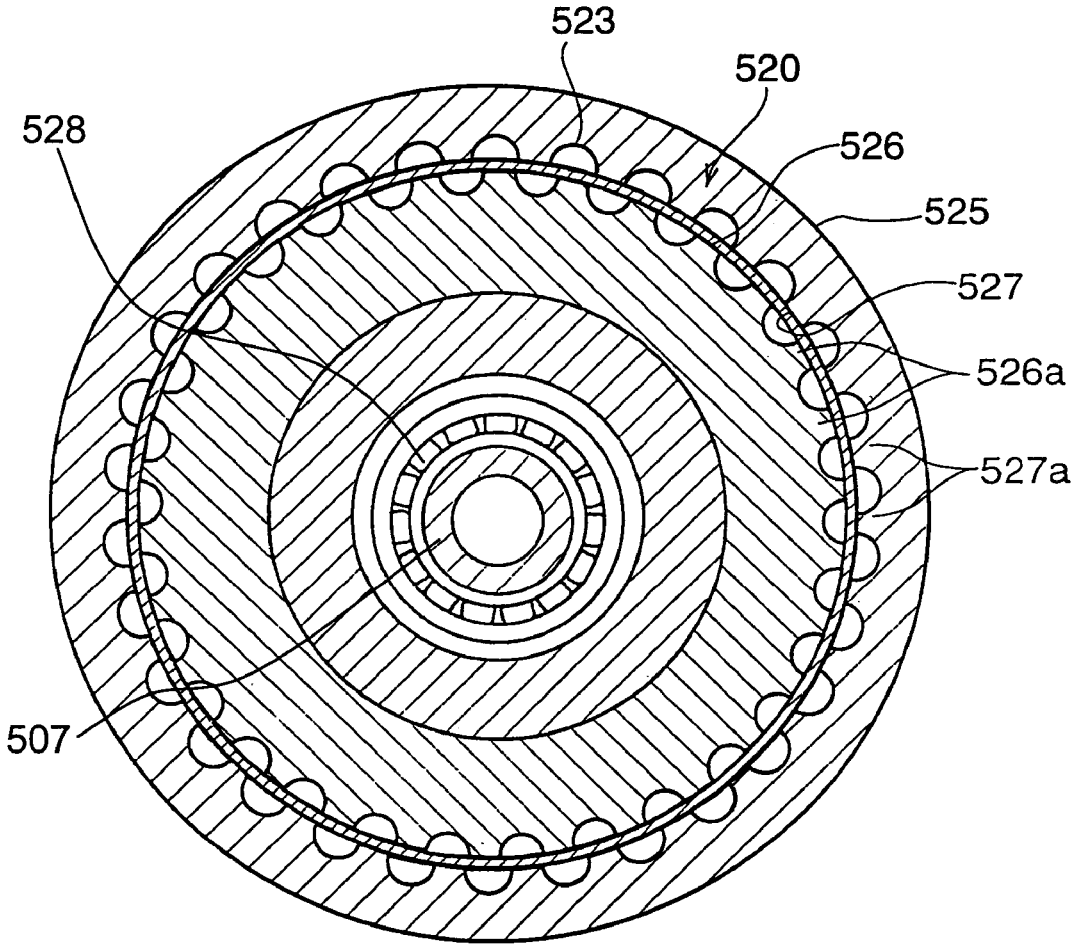
FIG. 8 is a diagram showing a hysteresis brake in the VTC, and corresponds to the cross-section taken along B—B in FIG. 2.

In the pair of facing surfaces 526 and 527, a plurality of irregularities are sequentially formed along the circumferential direction as shown in FIG. 8 (corresponding to the cross-section taken along B—B of FIG. 2), and convex portions 526*a* and 527*a* among those irregularities structure a magnetic pole (a magnetic field generating unit).

Then, convex portions 526*a* on the one facing surface 526 and convex portions 527*a* on the other facing surface 527 are disposed alternately in the circumferential direction, and adjacent convex portions 526*a* and 527*a* of facing surfaces 526 and 527 are entirely shifted in the circumferential direction.

Figure 9:
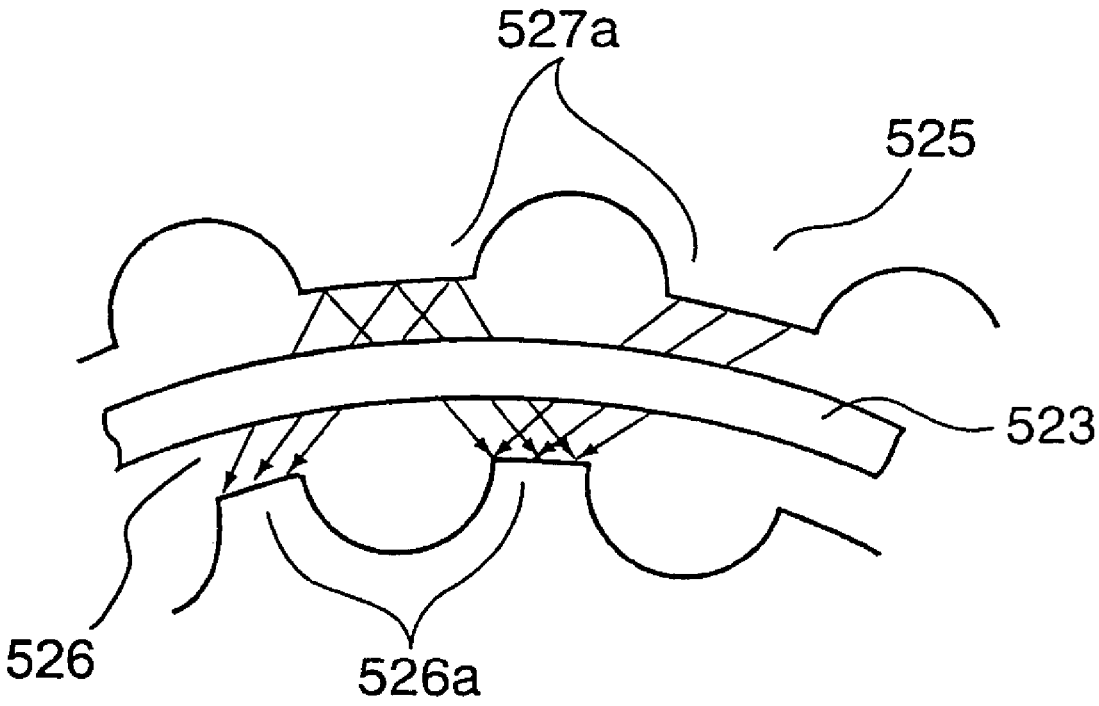
FIG. 9 is elements on large scale of FIG. 8, and shows directions of magnetic fields in the hysteresis brake.

Accordingly, a magnetic field deflected in the circumferential direction is generated between convex portions 526*a* and 527*a* adjacent to one another of facing surfaces 526 and 527 by excitation of electromagnetic coil 524 (refer to FIG. 9). Note that cylinder portion 523*a* of hysteresis ring 523 is set in the gap between both facing surfaces 526 and 527 in a non-contacting state.

Figure 10:
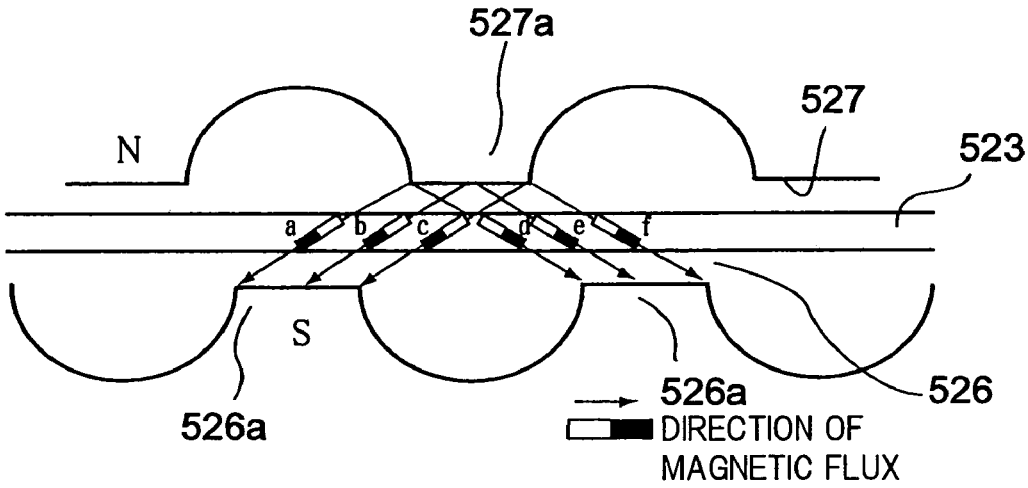
Figure 10:
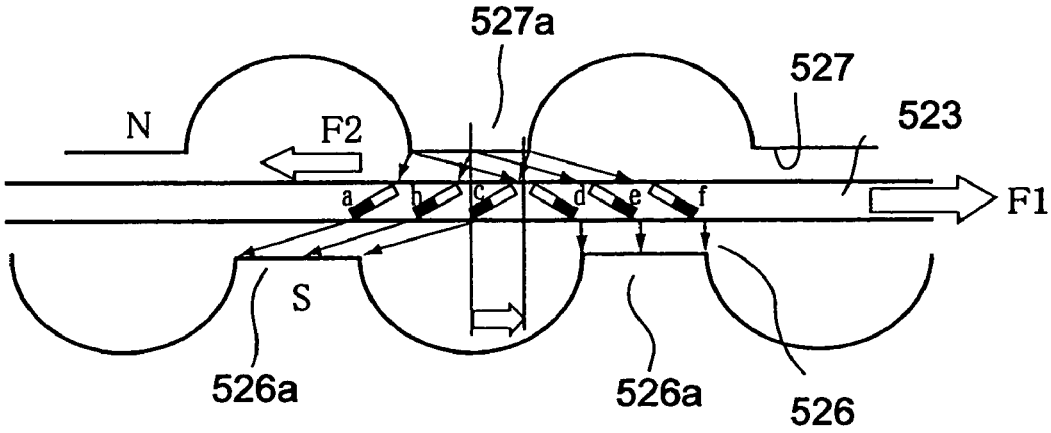

Here, the principle of operation of hysteresis brake 520 will be described by using FIG. 10. FIG. 10A shows a state in which hysteresis ring 523 (hysteresis material) is magnetized first, and FIG. 10B shows a state in which hysteresis ring 523 is displaced (rotated) from the state of FIG. 10A.

In the state of FIG. 10A, a flow of a magnetic flux is generated in hysteresis ring 523 so as to go along a direction of a magnetic field between both facing surfaces 526 and 527 of coil yoke 525 (a direction of a magnetic field going from convex portion 527*a* of facing surface 527 to convex portion 526*a* of facing surface 526).

When hysteresis ring 523 is transferred from this state to the state shown in FIG. 10B by receiving an external force F1, hysteresis ring 523 is displaced in the external magnetic field. Therefore, the magnetic flux inside hysteresis ring 523 has a phase delay at that time, and the direction of the magnetic flux inside hysteresis ring 523 is shifted (inclined) with respect to the direction of the magnetic field between facing surfaces 526 and 527.

Accordingly, a flow of the magnetic flux (line of magnetic force) entering hysteresis ring 523 from convex portion 527*a* of facing surface 527 and a flow of the magnetic flux (line of magnetic force) going from hysteresis ring 523 toward convex portion 526*a* of the other facing surface 526 are distorted, and at that time, a pull-against force such that the distortions in the magnetic fluxes are corrected is applied between facing surfaces 526 and 527 and hysteresis ring 523, and the pull-against force serves as a drag F2 braking hysteresis ring 523.

Namely, with respect to hysteresis brake 520, as described above, when hysteresis ring 523 is displaced in the magnetic field between facing surfaces 526 and 527, braking force is generated due to a divergence between the direction of the magnetic flux and the direction of the magnetic field inside hysteresis ring 523, and the braking force is made to be a constant value which is substantially in proportion to the strength of the magnetic field, i.e., a magnitude of an exciting current of electromagnetic coil 524 regardless of a rotational speed of hysteresis ring 523 (a relative velocity between facing surfaces 526 and 527 and hysteresis ring 523).

Figure 11:
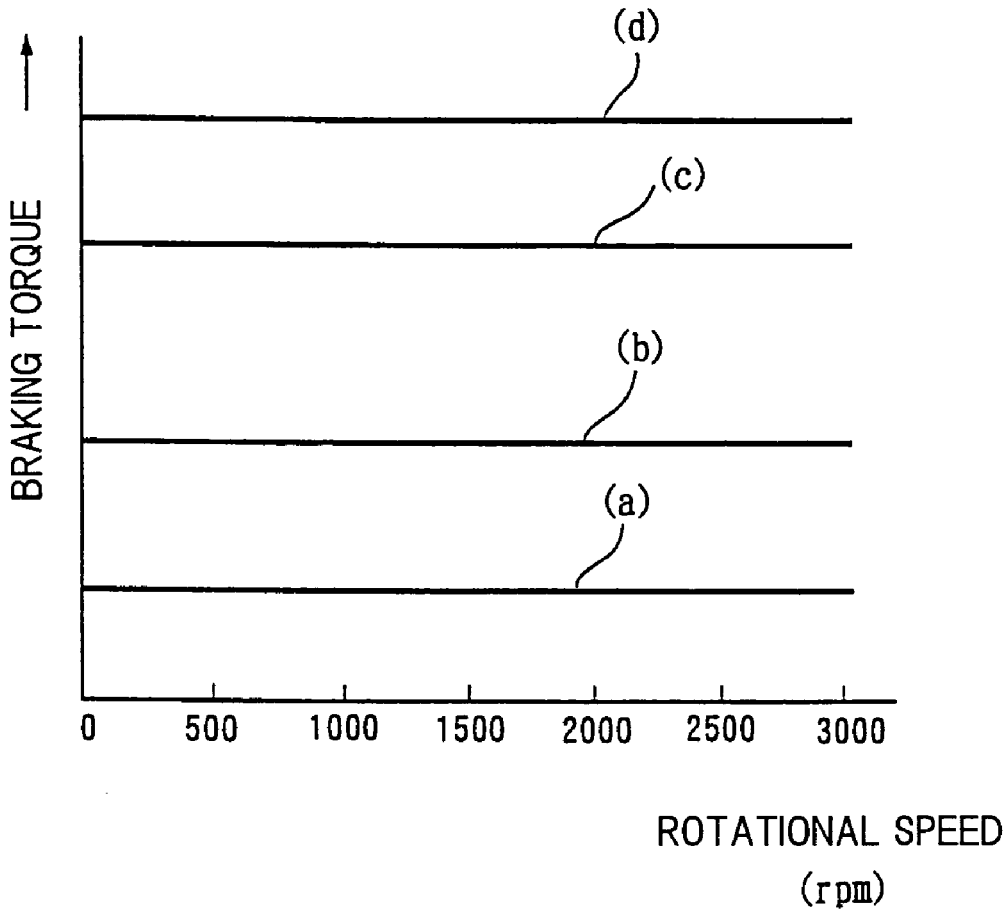
FIG. 11 is a graph showing a relationship between an engine rotational speed and a braking torque of the VTC.

Note that FIG. 11 is a test result in which a relationship between a rotational speed and a braking torque in hysteresis brake 520 is examined while changing an exciting current from a to d (a<b<c<d). As is clear from the test result, in accordance with hysteresis brake 520, a braking force which always corresponds to an exciting current can be obtained without any effect of a rotational speed.

Figure 12:
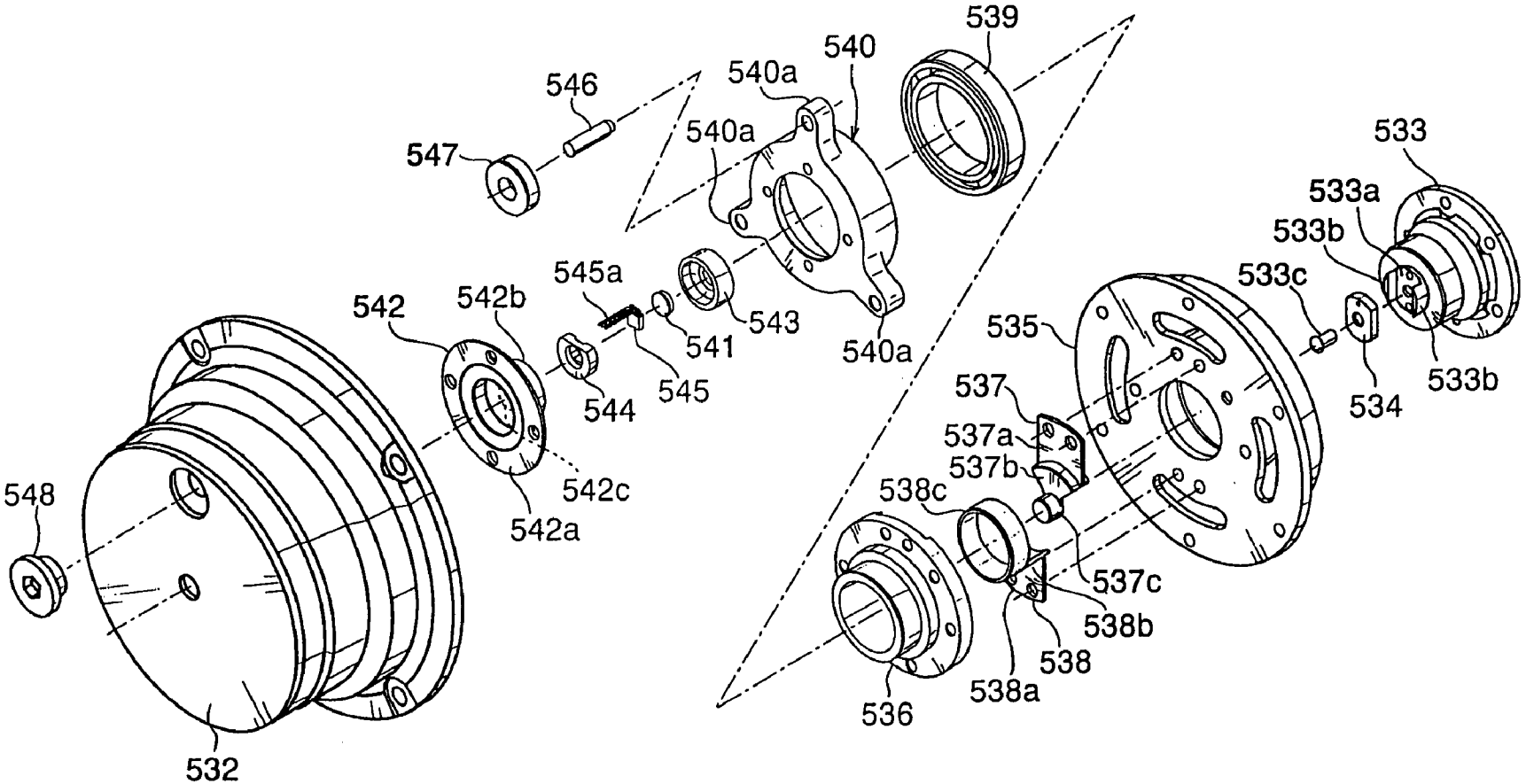
FIG. 12 is an exploded perspective view showing relative displacement detecting means of the VTC.
Figure 13:
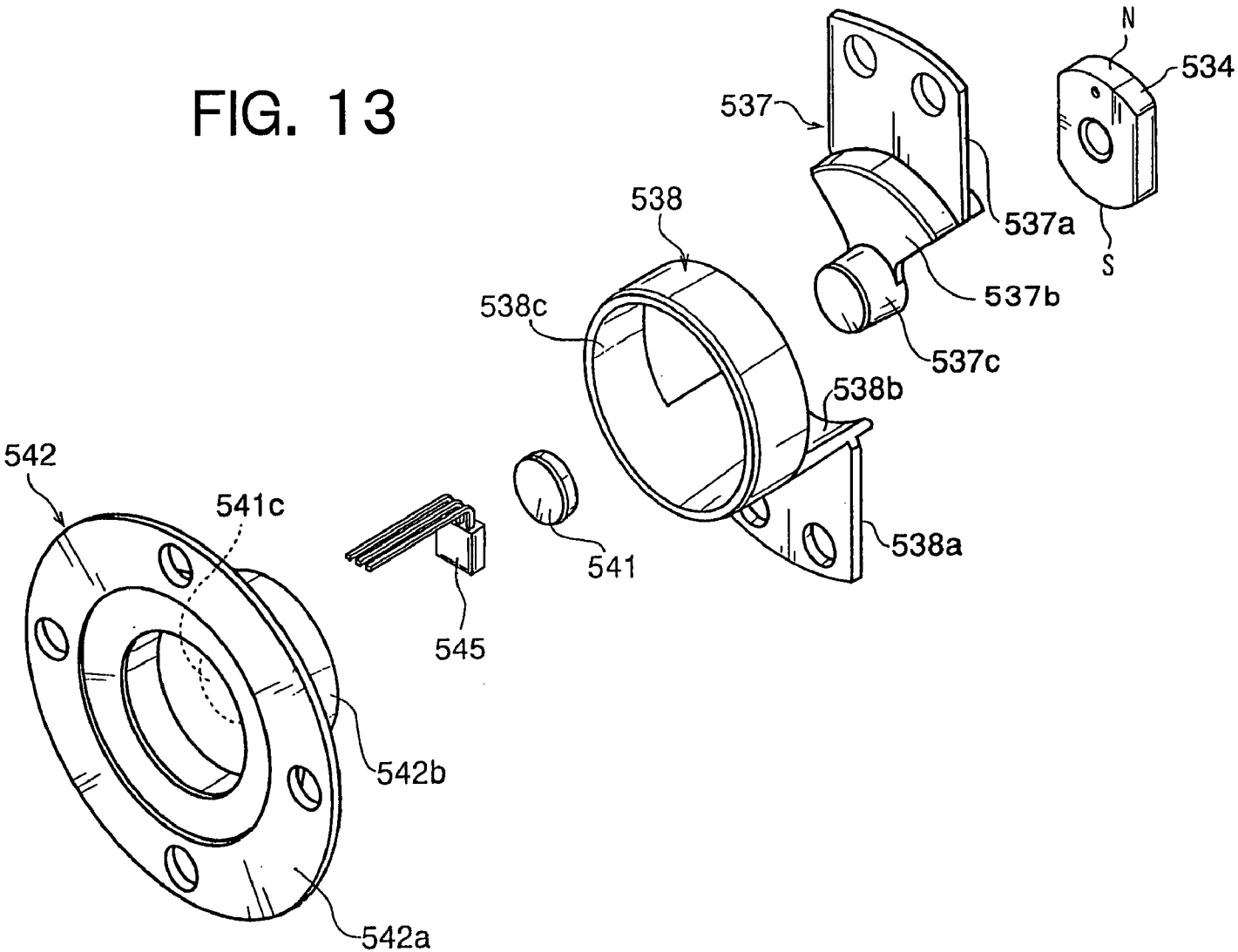
FIG. 13 is elements on large scale of FIG. 12.

As shown in FIG. 2, FIG. 12, and FIG. 13, relative displacement detecting means 506 is structured from a magnetic field generating mechanism provided at the side of driven shaft member 507, and a sensor mechanism which is provided at the side of VTC cover 532 which is the fixing unit side, and which detects a variation in a magnetic field from the magnetic field generating mechanism.

The magnetic field generating mechanism has a magnet base 533 formed from a non-magnetic material fixed at the front end side of flange 507*a* of driven shaft member 507, a permanent magnet 534 which is accommodated in a groove 533*a* formed at the top end portion of magnet base 533, and which is fixed by a pin 533*c*, a sensor base 535 fixed at the top end edge of cylinder portion 502*b* of timing sprocket 502, and first and second yoke members 537 and 538 which are fixed at the front end surface of sensor base 535 via a cylindrical yoke holder 536. A seal member 551 preventing dirt and the like from entering the sensor mechanism is set between the outer peripheral surface of magnet base 533 and the inner peripheral surface of sensor base 535.

As shown in FIG. 12, magnet base 533 has a set of protruded walls 533*b* and 533*b* forming groove 533*a* whose top and bottom are opened, and permanent magnet 534 is accommodated between both protruded walls 533*b* and 533*b*.

Permanent magnet 534 is formed in an oval so as to correspond to the shape of groove 533*a*, and the center of the top end portion and the center of the bottom end portion are respectively set to the centers of the north pole and the south pole.

As shown in FIG. 12 and FIG. 13, first yoke member 537 is structured from a plate shaped base portion 537*a* fixed to sensor base 535, a fan shaped yoke portion 537*b* provided so as to be integrated with the inner peripheral edge of the base portion 537*a*, and a cylindrical central yoke portion 537*c* provided so as to be integrated with a main portion of fan shaped yoke portion 537*b*. The rear end surface of central yoke portion 537*c* is disposed at the front surface of permanent magnet 534.

Second yoke member 538 is structured from a plate shaped base portion 538*a* fixed to sensor base 535, a plate shaped circular arc yoke portion 538*b* provided so as to be integrated with the upper end edge of base portion 538*a*, and a ring yoke portion 538*c* provided so as to be integrated with the rear end portion of circular arc yoke portion 538*b* in a same curvature. Ring yoke portion 538*c* is disposed so as to surround the outer peripheral side of a fourth yoke member 542 which will be described later.

The sensor mechanism has a ring shaped element holder 540, a third yoke member 541 serving as a rectifying yoke, a bottled cylinder shaped fourth yoke member 542 serving as a rectifying yoke, a synthetic resin protective cap 543, a protective member 544, and a Hall element 545.

Element holder 540 is disposed at the inside of VTC cover 532, and supports the front end portion of yoke holder 536 so as to be freely rotatable via ball bearing 539 fixed by being fitted into or the like. Further, as shown in FIG. 12, three protruding portions 540*a* are integrally provided at uniform intervals in the circumferential direction, and ends of pins 546 are respectively fixed to be press-fitted into fixing holes provided by drilling respective protruding portions 540*a*.

Further, the outer ring of ball bearing 539 is urged in the direction of camshaft 134 due to a spring force of a coil spring 549 set between the inner surface of VTC cover 532 and fourth yoke member 542, and in accordance therewith, positioning in the axis direction is carried out, and generation of looseness is prevented.

Further, three of holes 532*a* are formed at uniform intervals in the circumferential direction at the inner side of VTC cover 532, and rubber bushes 547 are respectively fixed to the insides of holes 532*a*. The other end portions of pins 546 are inserted into the holes drilled at the centers of respective rubber bushes 547, and in accordance therewith, element holder 540 is supported at VTC cover 532. Note that a stopper body 548 choking the openings at the outer sides of respective holding holes 506*a* is screwed up on VTC cover 532.

Third yoke member 541 is formed in a substantially disk type, and is disposed so as to face central yoke portion 537*c* of first yoke member 537 via an air gap G of a predetermined amount (about 1 mm).

An air gap G1 is formed between the inner peripheral surface of ring yoke portion 538*c* of second yoke member 538 and an outer peripheral surface of cylinder portion 542*b* of fourth yoke member 542.

Fourth yoke member 542 is fixed to the inner periphery of element holder 540 by a bolt and the like, and has a disk type base portion 542*a* fixed to element holder 540, a small-diameter cylinder portion 542*b* which is provided so as to be integrated with the side end surface of Hall element 545 of base portion 542*a*, and a protrusion 542*c* provided at the bottom wall surrounded by cylinder portion 542*b*. Protrusion 542*c* is disposed coaxially with permanent magnet 534, central yoke member 537*c* of first yoke member 537, and third yoke member 541.

Protective cap 543 is fixed to the inner peripheral surface of the cylinder portion 542*b* of fourth yoke member 542, and supports third yoke member 541.

Protective member 544 is fitted into to be attached to the outer periphery of a cylindrical protrusion 542*c* provided so as to be integrated with the center of the bottom wall of fourth yoke member 542.

Hall element 545 is maintained between third yoke member 541 and protrusion 542*c* of fourth yoke member 542, and a lead wire 545*a* thereof is connected to ECU 114.

VTC 113 is structured as described above, and during the time of rotating the engine (for example, during idling-driving before stopping), due to the excitation of electromagnetic coil 524 of hysteresis brake 520 being turned off, intermediate rotator 518 is made to rotate at the maximum in the direction in which engine is rotated with respect to timing sprocket 502 by the force of power spring 519 (refer to FIG. 3).

In accordance therewith, a rotational phase of camshaft 134 with respect to crankshaft 120 is maintained at the maximum retard side in which a valve timing of intake valve 105 is retarded at the maximum (the maximum retard timing).

When an instruction to vary the rotational phase to the maximum retard side from this state is ordered from ECU 114, the excitation of electromagnetic coil 524 of hysteresis brake 520 is turned on, braking force against the force of spiral spring 519 is applied to intermediate rotator 518. In accordance therewith, intermediate rotator 518 is moved to rotate with respect to timing sprocket 502, and in accordance therewith, engagement pins 516 at the top ends of links 511 are led to spiral slot 515, and the top end portions of links 511 are displaced along groove 508 in the radial direction, and as shown in FIG. 5, an assembling angle between timing sprocket 502 and driven shaft member 307 is varied to be at the maximum advance side due to the effects of links 511. As a result, the rotational phase is at the maximum advance side in which the valve timing of intake valve 105 is advanced at the maximum (the maximum advance timing).

Moreover, when an instruction that the rotational phase is varied from this state (the maximum advance side) to the maximum retard side is ordered from ECU 114, the excitation of electromagnetic coil 524 of hysteresis brake 520 is turned off, and intermediate rotator 518 is moved to rotate in the direction of returning by the force of spiral spring 319 again. Then, links 311 swing in the direction opposite to the direction described above due to engagement pins 316 being led by spiral slot 315, and as shown in FIG. 3, an assembling angle between timing sprocket 302 and driven shaft member 307 is varied to be at the maximum advance side due to the effects of links 311.

The rotational phase (of camshaft 134 with respect to the crank shaft) varied by VTC 113 can be varied to be, not only two types of phases at the maximum retard side and the maximum advance side described above, but also an arbitrary phase such as, for example, an intermediate advance state shown in FIG. 4, by the control of the braking force of hysteresis brake 520, and the phase can be maintained by the balance of the force of power spring 519 and the braking force of hysteresis brake 520.

Further, detection of a relative displacement angle (rotational phase) by relative displacement detecting means 506 is carried out as follows. Note that FIG. 14 schematically shows relative displacement detecting means 506.

Figure 14:
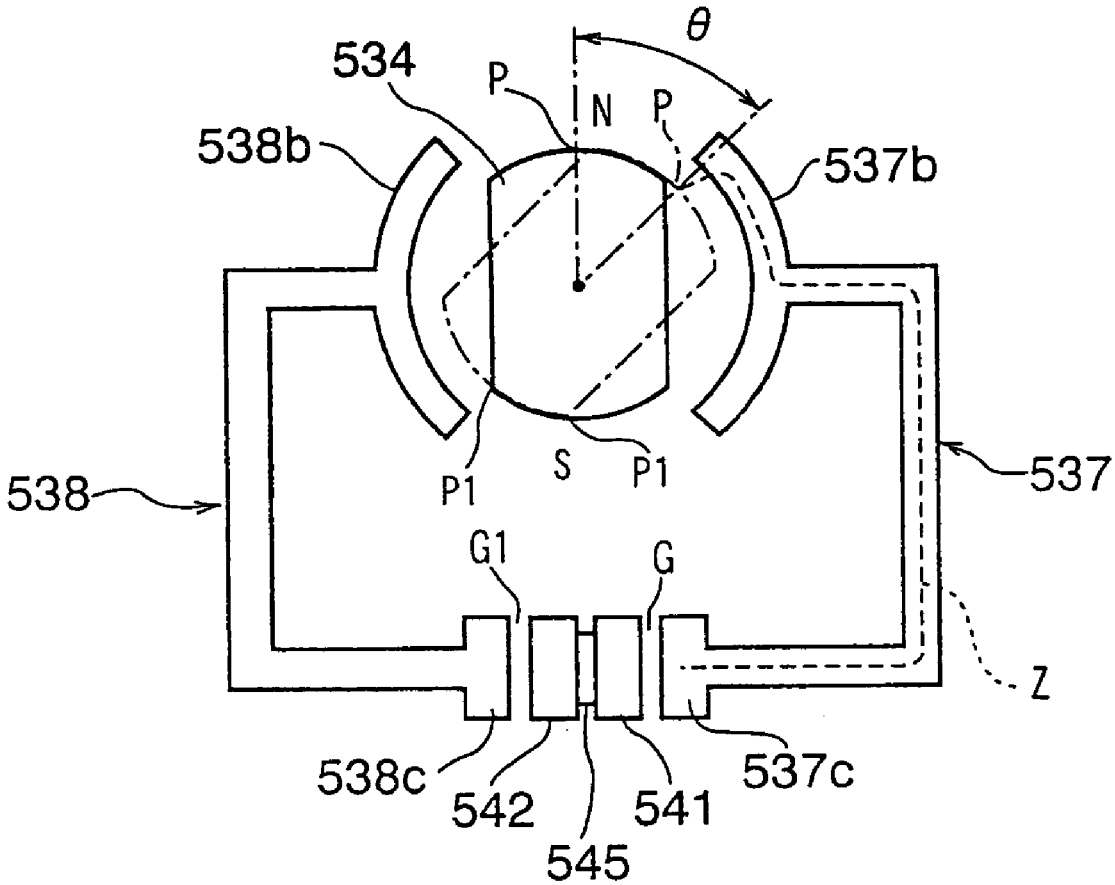
FIG. 14 is a diagram schematically showing the relative displacement detecting means of the VTC.

As shown in FIG. 14, a relative rotational phase between camshaft 134 and timing sprocket 502 is varied, and when permanent magnet 534 of relative displacement detecting means 506 is rotated, for example, by an angle of 0, a magnetic field Z outputted from the center P of the north pole is transmitted to fan shaped yoke portion 537*b* of first yoke member 537, and is transmitted to central yoke member 537*c*, and moreover, magnetic field Z is transmitted to Hall element 545 through third yoke member 541 via air gap G.

Magnetic field Z which has been transmitted to Hall element 545 is transmitted to cylinder portion 542*b* of fourth yoke member 542 via protrusion 542*c* of fourth yoke member 542 from Hall element 545, and is further transmitted to ring yoke portion 538*c* of second yoke member 538 via air gap G1, and is returned to the south pole of permanent magnet 534 via circular arc yoke portion 538*b*.

Because the magnetic flux density of magnetic field Z is sequentially varied due to rotational angle 0 of permanent magnet 534 being sequentially varied, the sequential variation in the magnetic flux density is detected by Hall element 545, and a variation in the voltages thereof is outputted to ECU 114.

Accordingly, at ECU 114, a relative rotational displacement angle (an advance value of a rotational phase) of camshaft 134 with respect to crankshaft 120 can be sequentially found in an arbitrary timing by a computation on the basis of the sequential detection signals (variations in voltage) outputted from Hall element 545 via lead wire 545*a*.

Namely, ECU 114 in the present embodiment can detect a rotational phase (a valve timing of intake valve 105) of intake side camshaft 134 with respect to crank shaft 120 at each rotational period of intake side camshaft 134 on the basis of output signals of crank angle sensor 117 and cam sensor 132 (first rotational phase detecting means), and can sequentially detect the rotational phase in arbitrary timings on the basis of an output signal of Hall element 545 (second rotational phase detecting means).

Figure 15:
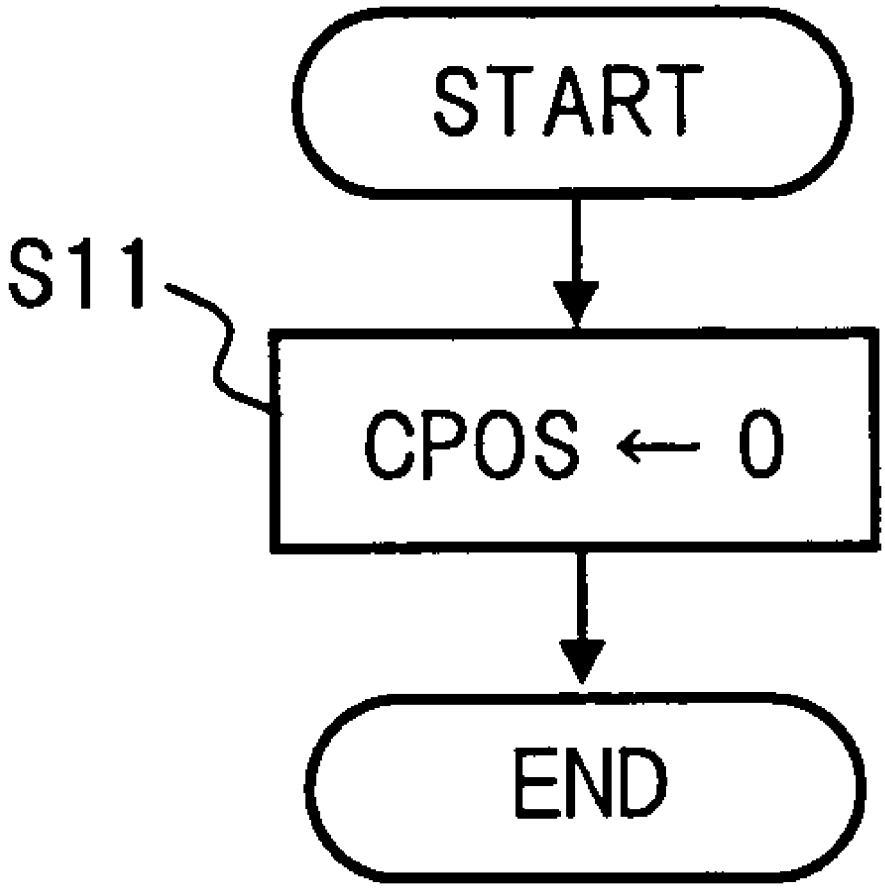
FIG. 15 is a flowchart showing CPOS resetting processing for each reference crank angle signal REF.
Figure 16:
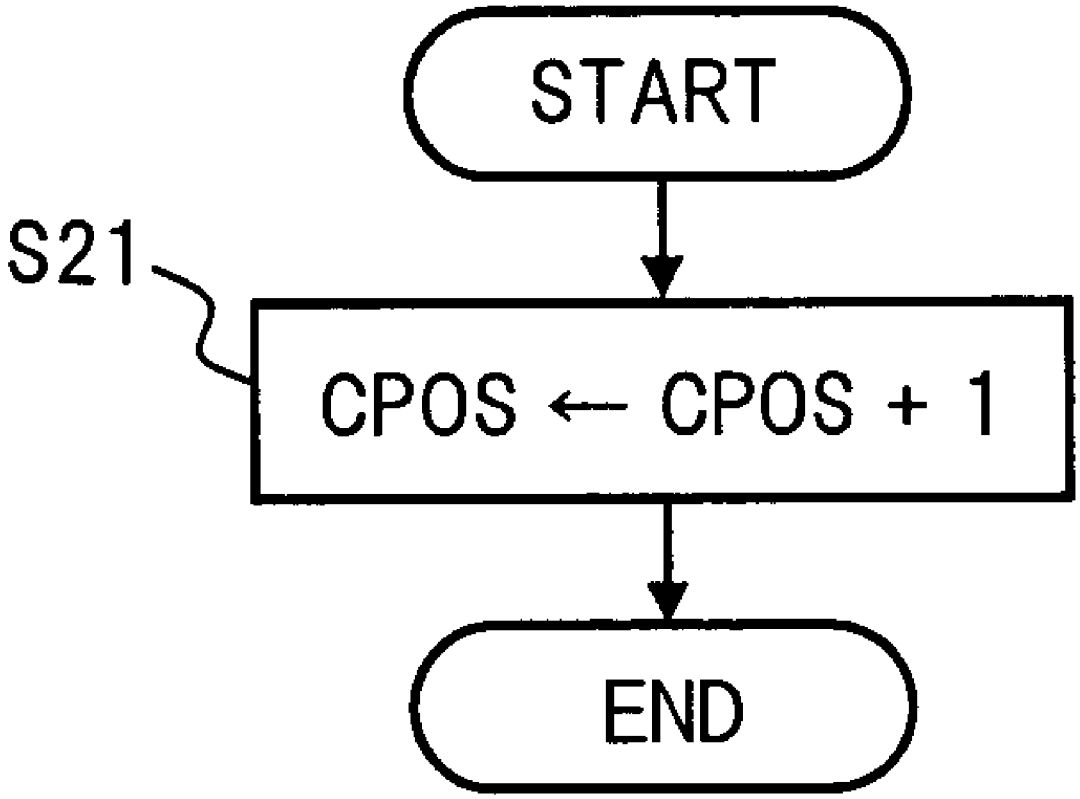
FIG. 16 is a flowchart showing CPOS counting-up processing for each unit angle signal POS.
Figure 17:
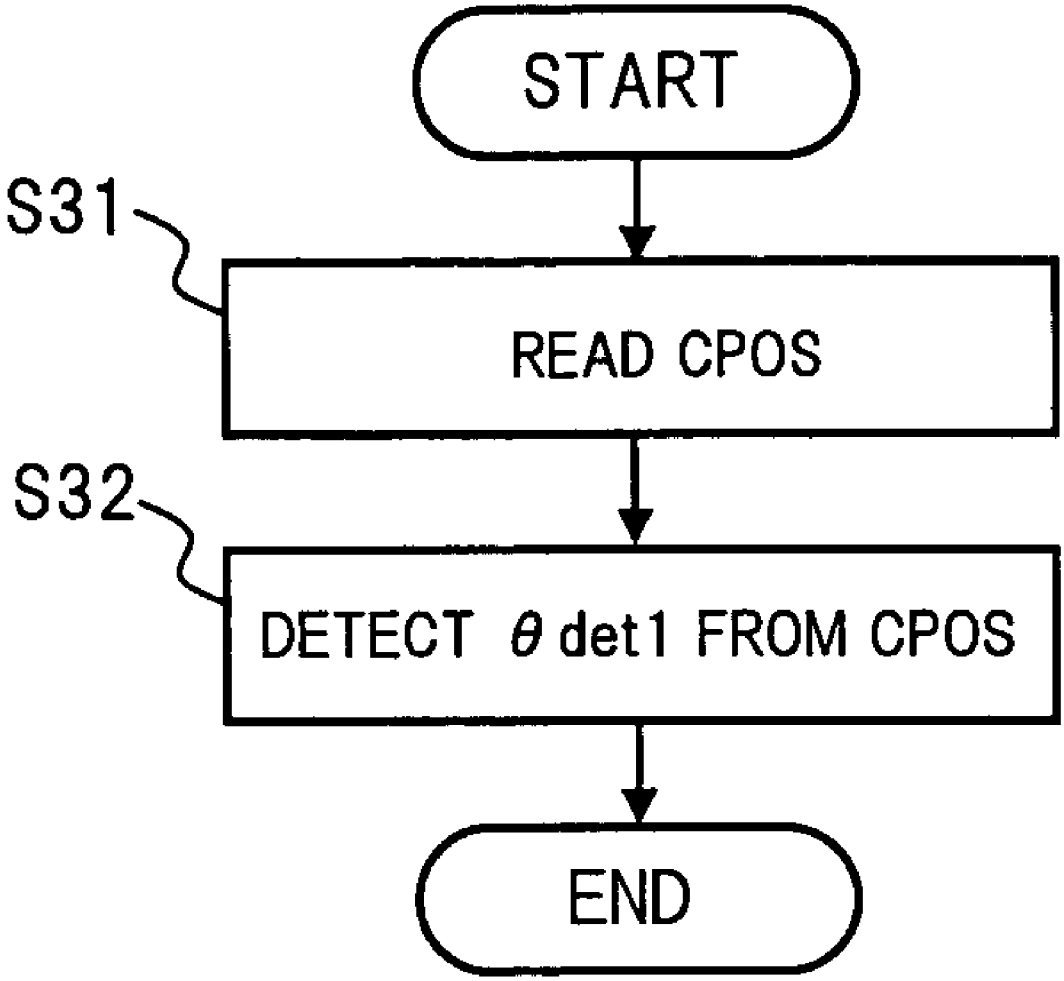
FIG. 17 is a flowchart showing advance value θdet1 detecting processing for each cam signal CAM.

To describe concretely, the first rotational phase detecting means detects (calculates) the rotational phase by counting unit angle signals POS (measuring time) from the time when a reference crank angle signal REF is generated up to the time when a cam signal CAM is generated (refer to FIG. 15 to FIG. 17).

On the other hand, the second rotational phase detecting means detects (calculates) the rotational phase on the basis of a sequential variation in the magnetic flux density of magnetic field Z detected by Hall element 545.

Then, in the present embodiment, at the time of low-speed rotating in which a detection period of a rotational phase by the first rotational phase detecting means (i.e., a rotational phase of camshaft 134) is made longer than a valve timing control period, due to VTC 113 being controlled such that the rotational phase detected by the second rotational phase detecting means is made to be a predetermined target rotational phase, the inconvenience brought about due to the rotational phase detection period being made longer than the valve timing control period (deterioration in the controllability) is avoided, and highly responsive and highly precise valve timing control is realized.

On the other hand, at the time of intermediate/high-speed rotating in which there is no inconvenience as described above, stable valve timing control is realized due to VTC 113 being controlled such that the rotational phase detected by the first rotational phase detecting means is made to be a predetermined target rotational phase.

Here, in the present embodiment, valve timing (rotational phase) control executed by ECU 114 will be described.

FIG. 15 to FIG. 17 are flowcharts for detecting a rotational phase (hereinafter, this will be called a first rotational phase θdet1) on the basis of output signals from the crank angle sensor and the cam sensor, i.e., by the first rotational phase detecting means.

FIG. 15 is a flowchart for carrying out processing for resetting a counted value CPOS of unit angle signals POS, and the processing is executed when a reference crank signal REF is outputted from crank angle sensor 117. At S11, a counted value CPOS of unit angle signals POS from crank angle sensor 117 is set to 0.

FIG. 16 is a flowchart for carrying out count-up processing for a counted value CPOS of unit angle signals POS, and the processing is executed when unit angle signals POS are outputted from crank angle sensor 117. At S21, the counted value CPOS is counted up by one.

In accordance with the above-described flows of FIG. 15 and FIG. 16, the counted value CPOS is reset to 0 when a reference crank angle signal REF is generated, and becomes a value in which the number of generating unit angle signals POS thereafter is counted.

FIG. 17 is a flowchart for detecting a first rotational phase θdet1, and the detection is executed when a cam signal CAM is outputted from cam sensor 132.

At S31, the counted value CPOS from the time when a reference crank angle signal REF is generated and up to the time when a cam signal CAM is generated is read.

At S32, a first rotational phase θdet1 is detected on the basis of the read counted value CPOS. Namely, at the first rotational phase detecting means, a rotational phase (first rotational phase) θdet1 of camshaft 134 with respect to crankshaft 120 is detected every time when a cam signal CAM is outputted (each crank angle of 180 degrees).

Figure 18:
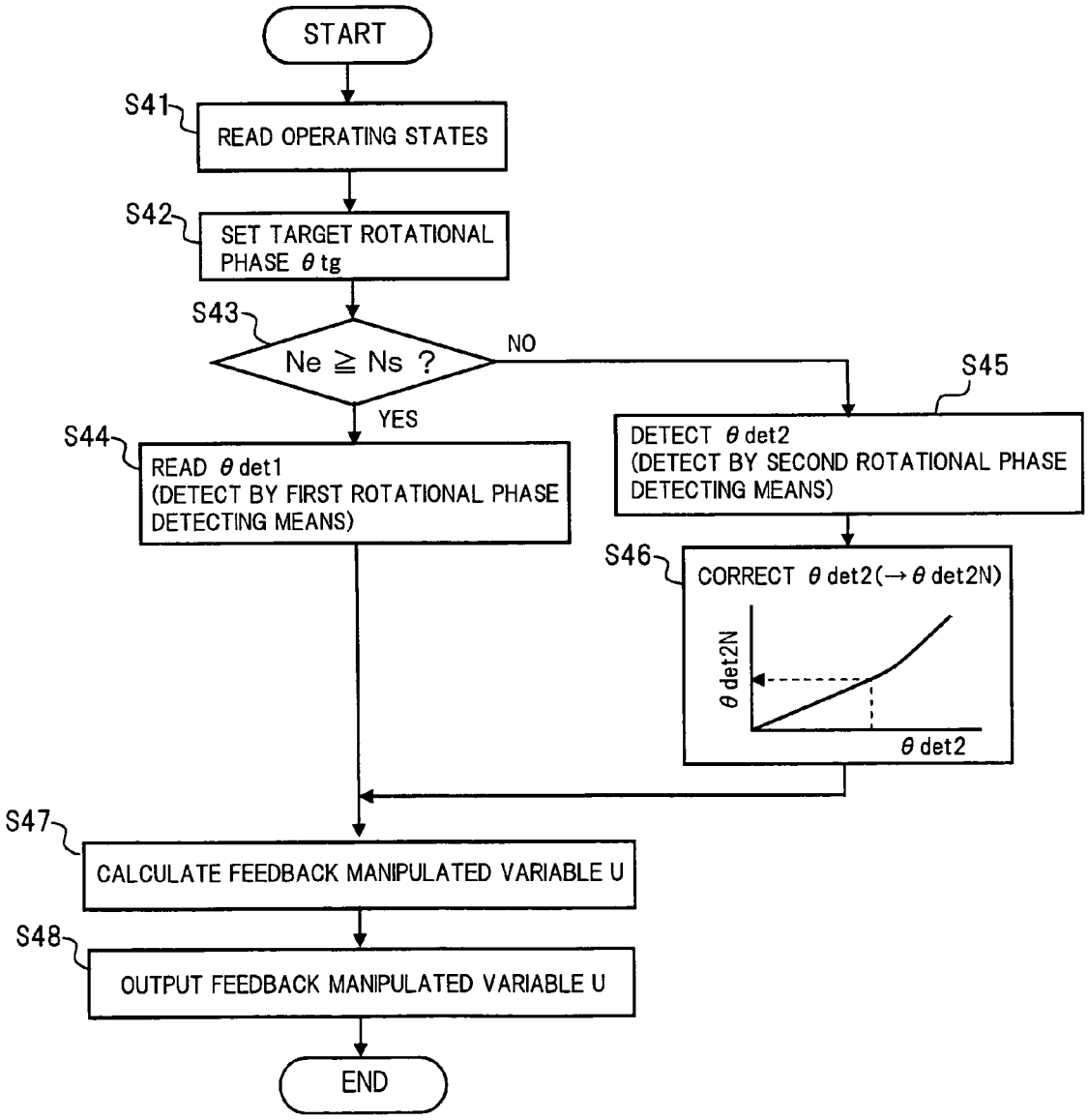
FIG. 18 is a flowchart showing valve timing control relating to the present embodiment.

FIG. 18 is a flowchart of valve timing (rotational phase) control relating to the present embodiment, and the control is started when a key switch is turned on, and is executed at predetermined times (for example, 10 ms).

At S41, engine operating states such as an engine rotational speed Ne, an intake air quantity Qa, a cooling water temperature Tw, and the like are read.

At S42, a target rotational phase (target valve timing) θtg is set on the basis of the read engine operating states.

At S43, it is judged whether or not an engine rotational speed Ne is greater than or equal to a predetermined rotational speed Ns set in advance. When it is Ne≧Ns, the routine proceeds to S44, and the first rotational phase θdet1 (latest value) detected by the aforementioned FIG. 15 to FIG. 17, i.e., the aforementioned first rotational phase detecting means is read. On the other hand, when it is Ne<Ns, the routine proceeds to S45. Note that the predetermined rotational speed Ns is a rotational speed by which a rotational phase detection period by the first rotational phase detecting means is made longer than an execution period of this flow (valve timing control period).

At S45, a rotational phase (hereinafter, this will be called a second rotational phase θdet2) is detected on the basis of an output (detection) signal of Hall element 545, i.e., by the second rotational phase detecting means.

At S46, the detected second rotational phase θdet2 is corrected by using a correction table as shown in the drawing (θdet2→θdet2N). In such a correction table, as will be described later, the contents thereof are updated when predetermined conditions are satisfied (refer to FIG. 19 to FIG. 23).

At S47, on the basis of the target rotational phase θtg set at S42, and the first rotational phase θdet1 read at S44 or the second rotational phase θdet2N corrected at S46, a manipulated variable of VTC113 (feedback manipulated variable) U is calculated by PID control or the like.

At S48, the calculated manipulated variable U is outputted to VTC 113, and this flow is completed.

The second rotational phase detecting means can detect a rotational phase (second rotational phase θdet2) in an arbitrary timing regardless of a rotational period of camshaft 134. However, Hall element 545 has a structure in which a signal corresponding to a magnetic flux density is outputted, and the output characteristics thereof may be changed due to long-term usage and the like in some cases. In such a case, because detection of a rotational phase by the second rotational phase detecting means cannot be precisely carried out, and the controllability of valve timing control at the time of low-speed rotating deteriorates, it is necessary to rectify the problem.

On the other hand, with respect to the first rotational phase θdet1 detected by the first rotational phase detecting means, it has been conventionally verified that, although the detection period thereof is made longer at the time of low-speed rotating, it is possible to stably and precisely detect a rotational phase at the detecting time, and it is hard to bring about an error in detection and a variation in characteristics.

Then, in the present embodiment, as described above, at the time of low-speed rotating, the second rotational phase θdet2 is corrected by using the correction table, and valve timing control is carried out on the basis of the corrected second rotational phase θdet2N. Here, such a correction table is updated supposing that the first rotational phase θdet1 is correct, and a deviation of the second rotational phase θdet2 due to a change in the output characteristics or the like of Hall element 545 is modified.

Hereinafter, correction table updating control (i.e., correction value learning control) will be described.

Figure 19:
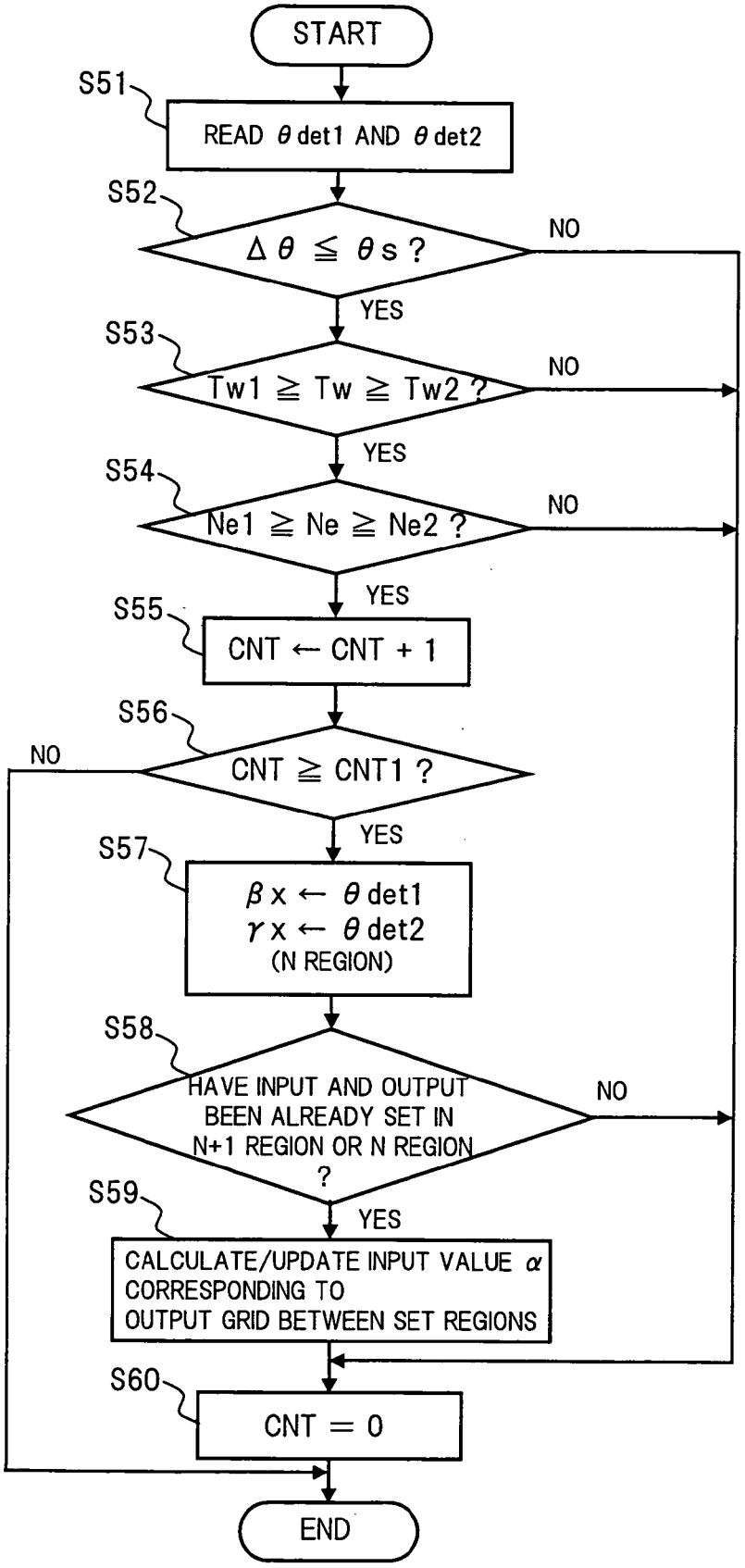
FIG. 19 is a flowchart showing correction table updating control 1 (correction value learning control 1).

FIG. 19 is a flowchart showing correction table updating control (1), and the control is executed when a cam signal CAM is outputted from cam sensor 132. In this flow, input values corresponding to output grids of regions divided in advance are updated in the above-described correction table.

At S51, a first rotational phase θdet1 and a second rotational phase θdet2 are read.

At S52, it is judged whether or not a variation Δθ from a previous value θ(−1) of a rotational phase θ is less than or equal to a predetermined amount θs (~0) set in advance. Note that such a judgment may be carried out by using any of a first rotational phase θdet1 and a second rotational phase θdet2. When it is Δθ≦θs, it is judged that VTC 113 maintains a predetermined rotational phase (the rotational phase has not been varied), and the routine proceeds to S53, and when it is Δθ>θs, the routine proceeds to S60.

At S53, it is judged whether or not a cooling water temperature (engine temperature) Tw is within a predetermined range (Tw1≧Tw≧Tw2) set in advance. The reason for that such a judgment is carried out is for taking the temperature characteristic of Hall element 545 into consideration. When the cooling water temperature Tw is within a predetermined range, the routine proceeds to S54, and in other cases, the routine proceeds to S60.

At S54, it is judged whether or not an engine rotational speed Ne is within a predetermined range (Ne1≧Ne≧Ne2) set in advance. The reason for that the judgment is carried out is for eliminating the effect of the engine rotational speed Ne. When the engine rotational speed Ne is within a predetermined range, the routine proceeds to S55, and in other cases, the routine proceeds to S60.

At S55, a counted value CNT is counted up by one (CNT←CNT+1). This counted value CNT denotes an elapsed time from the time when all the conditions at S52 to S54 have been met.

At S56, it is judged whether or not the counted-up counted value CNT reaches the predetermined value CNT 1 set in advance. When the counted value CNT has reached the predetermined value CNT 1, it is judged that a predetermined time has passed from the time when all the conditions had been met, and the routine proceeds to S57, and when the counted value CNT has not reached the predetermined value CNT 1, the routine returns to S52.

At S57, the first rotational phase θdet1 and the second rotational phase θdet2 which have been read are respectively set to an output βx and an input γx in the aforementioned correction table. Here, suppose that the output βx and the input γx which have been set belong to an N region in the divided correction table.

At S58, it is judged whether or not the first rotational phase θdet1 and the second rotational phase θdet2 have been already set to an output βx and an input γx in one of the regions adjacent to N region (N+1 region or N−1 region). When the first rotational phase θdet1 and the second rotational phase θdet2 have been already set to the output βx and the input γx, the routine proceeds to S59, and in other cases, the routine proceeds to S60.

Figure 20:
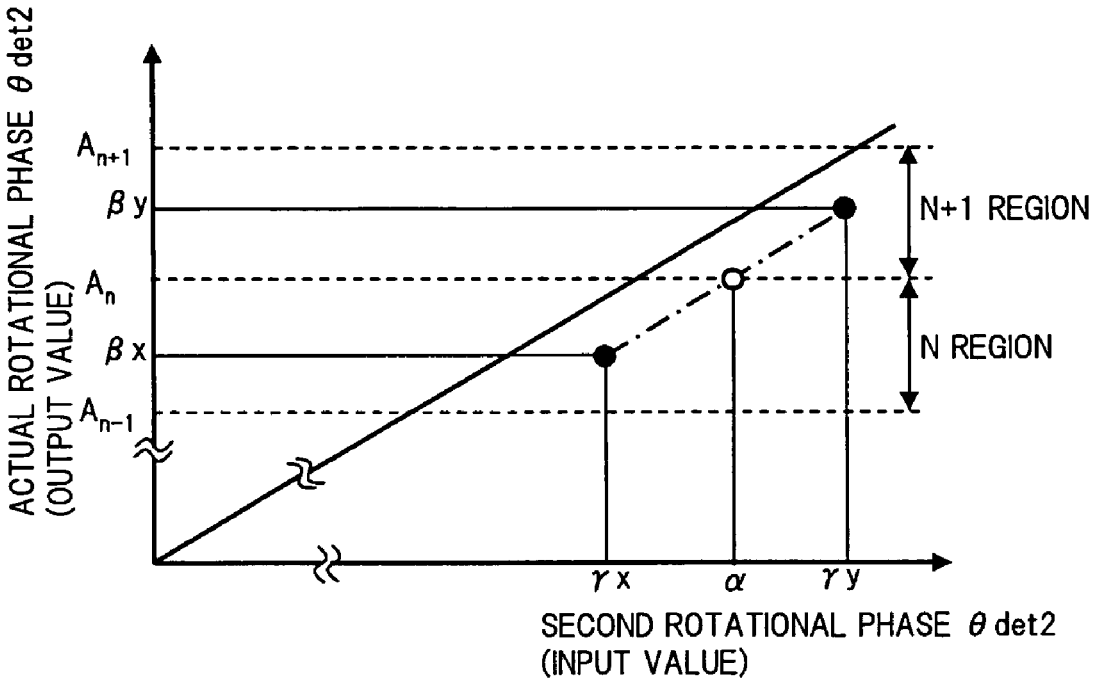
FIG. 20 is a diagram for explanation of the contents of the correction table updating control 1 (correction value learning control 1).

At S59, an input value α corresponding to an output grid between the regions in which the input and the output have been set already is calculated, and is updated. For example, as shown in FIG. 20, when an output βx and an input γx have been set in N region, and an output βy and an input γy have been set in N+1 region, an input value (a correction table value) α corresponding to an output grid An between N region and N+1 region is updated by being calculated by the following formula (linear interpolation).

$$\alpha=\gamma x+\{(\gamma y-\gamma x)/(\beta y-\beta x)\}*(An-\beta x)$$

At S60, the counted value CNT is cleared, and this flow is completed.

In this way, the correction table (correction value) for correcting the second rotational phase θdet2 is modified (learned) with the first rotational phase θdet1 as a reference, and due to the second rotational phase θdet2 being corrected by using this correction table, a deviation of the second rotational phase θdet2 can be modified so as to correspond to a change in the output characteristics of Hall element 545.

Figure 21:
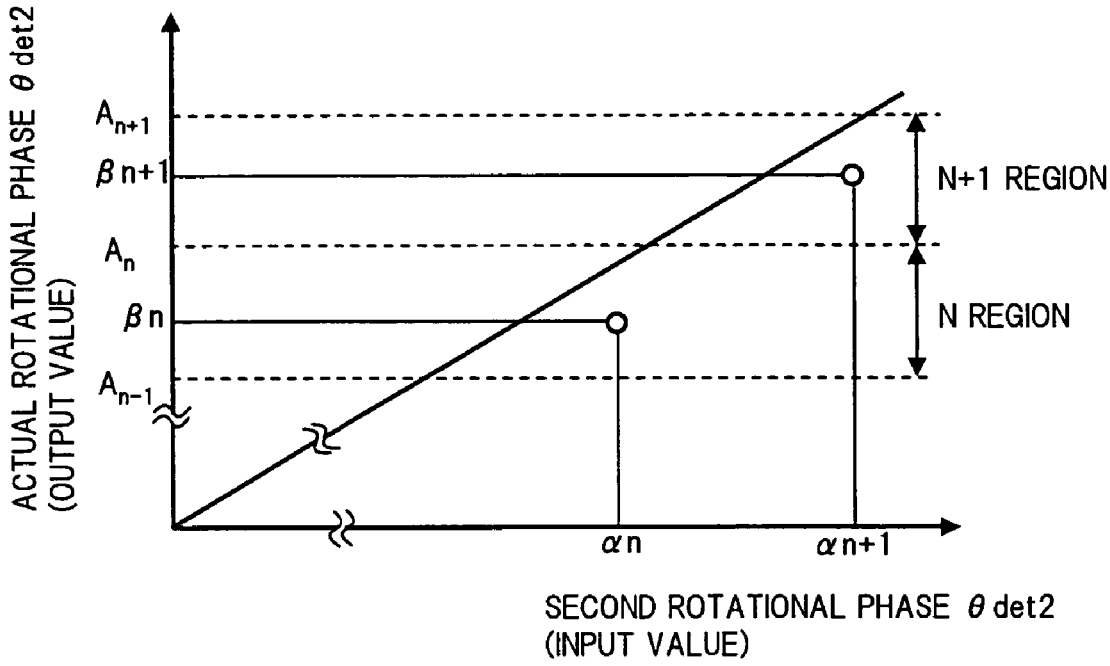
FIG. 21 is a diagram for explanation of the contents of another correction table updating control (correction value learning control).
Figure 22:
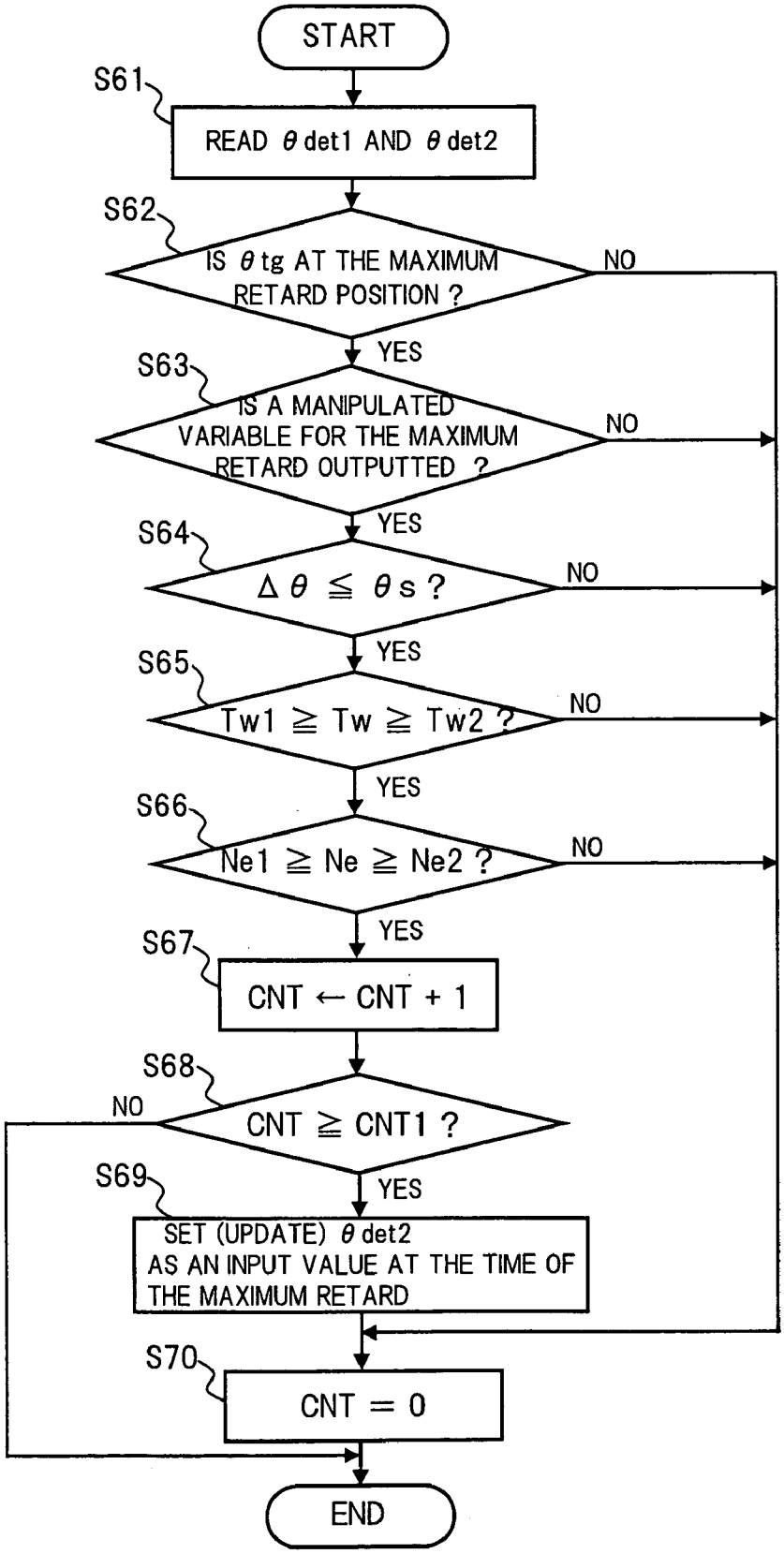
FIG. 22 is a flowchart showing correction table updating control 2 (correction value learning control 2).

Note that, in the above descriptions, only the input values corresponding to the respective output grids ($A_1$, $A_2$, . . . $A_{n-1}$, An, $A_{n+1}$, . . . ) in the correction table are updated. However, as shown in FIG. 21, both of the input values and the output values may be updated due to the first rotational phase θdet1 and the second rotational phase θdet2 being made to be correction table values (input αn=θdet2, output βn=θdet1) in the corresponding regions. In this way as well, the correction table (correction value) for correcting the second rotational phase θdet2 is modified (learned) with the first rotational phase θdet1 as a reference.

FIG. 20 is a flowchart showing correction table updating control (2), and the control is executed when a cam signal CAM is outputted from cam sensor 132. In this flow, an input value when the rotational phase is at the maximum retard side (an input value corresponding to the maximum retard position) in the above-described correction table is updated.

At S61, a first rotational phase θdet1 and a second rotational phase θdet2 are read.

At S62, it is judged whether or not a target rotational phase θtg is at the maximum retard position. When the target rotational phase θtg has been at the maximum retard position, the routine proceeds to S63, and in other cases, the routine proceeds to S70.

At S63, it is judged whether or not a manipulated variable for the maximum retard is outputted to VTC 113 (for example, it is duty=0). When the manipulated variable for the maximum retard has been outputted to VTC 113, the routine proceeds to S64, and in other cases, the routine proceeds to S70.

Because S64 to S68 are the same as S52 to S56 in FIG. 18, descriptions thereof will be omitted. Note that, in this flow, the fact that a variation in a rotational phase is less than or equal to a predetermined value means that the rotational phase is controlled to be at the maximum retard, and a counted value CNT denotes an elapsed time from the time when all the conditions at S62 to S66 have been met. Then, at S68, when the counted value CNT has reached a predetermined value CNT1, the routine proceeds to S69, and when the counted value CNT has not reached the predetermined value CNT1, the routine returns to S62.

At S69, the read second rotational phase θdet2 is updated as an input value corresponding to the maximum retard position (output value) in the correction table.

At S70, the counted value CNT is cleared (CNT=0), and this flow is completed.

In accordance therewith, the input value corresponding to the maximum retard position (correction table value) is modified (updated) in accordance with a change in the output characteristics of Hall element 545.

Figure 23:
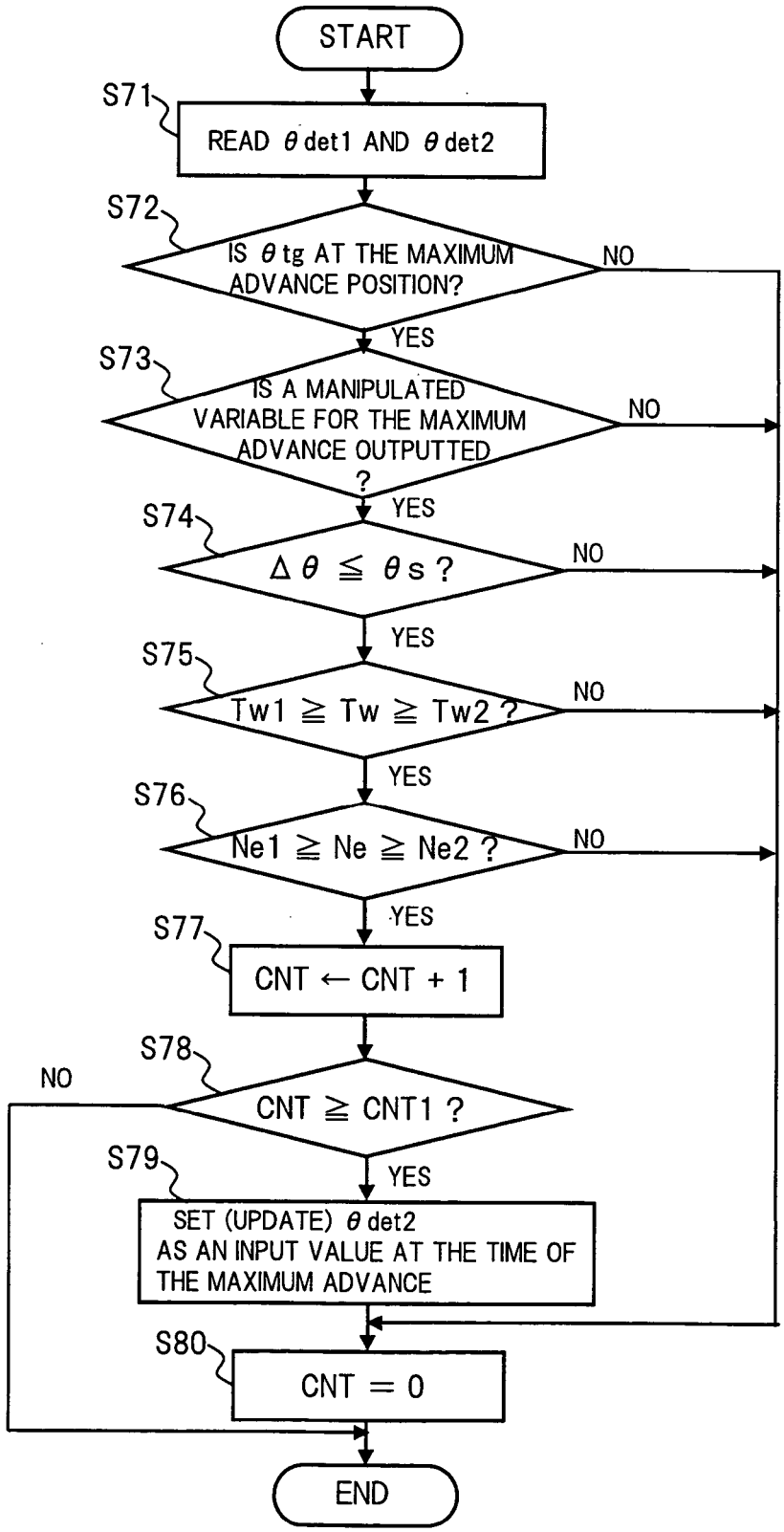
FIG. 23 is a flowchart showing correction table updating control 3 (correction value learning control 3).

FIG. 23 is a flowchart showing correction table updating control (3), and the control is executed when a cam signal CAM is outputted from cam sensor 132. In this flow, an input value when the rotational phase is at the maximum advance side (an input value corresponding to the maximum advance position) is updated in the correction table.

In this flow, there are differences from the flow in FIG. 20 in the points that it is judged whether or not a target rotational phase θtg is at the maximum advance position at S72, it is judged whether or not a manipulated variable for the maximum advance is outputted to VTC 113 at S73, and the read second rotational phase θdet2 is updated as an input value corresponding to the maximum advance position (output value) in the correction table at S79, and in accordance therewith, the input value corresponding to the maximum advance position (correction table value) is modified (updated) in accordance with a change in the output characteristics of Hall element 545. Note that, because the other steps are the same as those in FIG. 20, descriptions thereof will be omitted.

Then, due to the above-described correction table updating controls (1) to (3) being repeated, the input values corresponding to the respective output grids, the maximum retard position, and the maximum advance position (correction table values) are updated, and the correction table for correcting the second rotational phase θdet2 (correction values) are modified in accordance with a change in the output characteristics of Hall element 545. Therefore, by correcting the second rotational phase (detected value) θdet2 by using this correction table, and by executing valve timing control on the basis of a corrected value (θdet2N), the precise of valve timing control, in particular, at the time of low-speed rotating can be highly maintained.

In the present embodiment, at the time of low-speed rotating, VTC 113 is controlled such that the rotational phase detected by the second rotational phase detecting means is made to be a predetermined target rotational phase, and Hall element 545 is used as the second rotational phase detecting means. However, the embodiment is not limited thereto.

Figure 24:
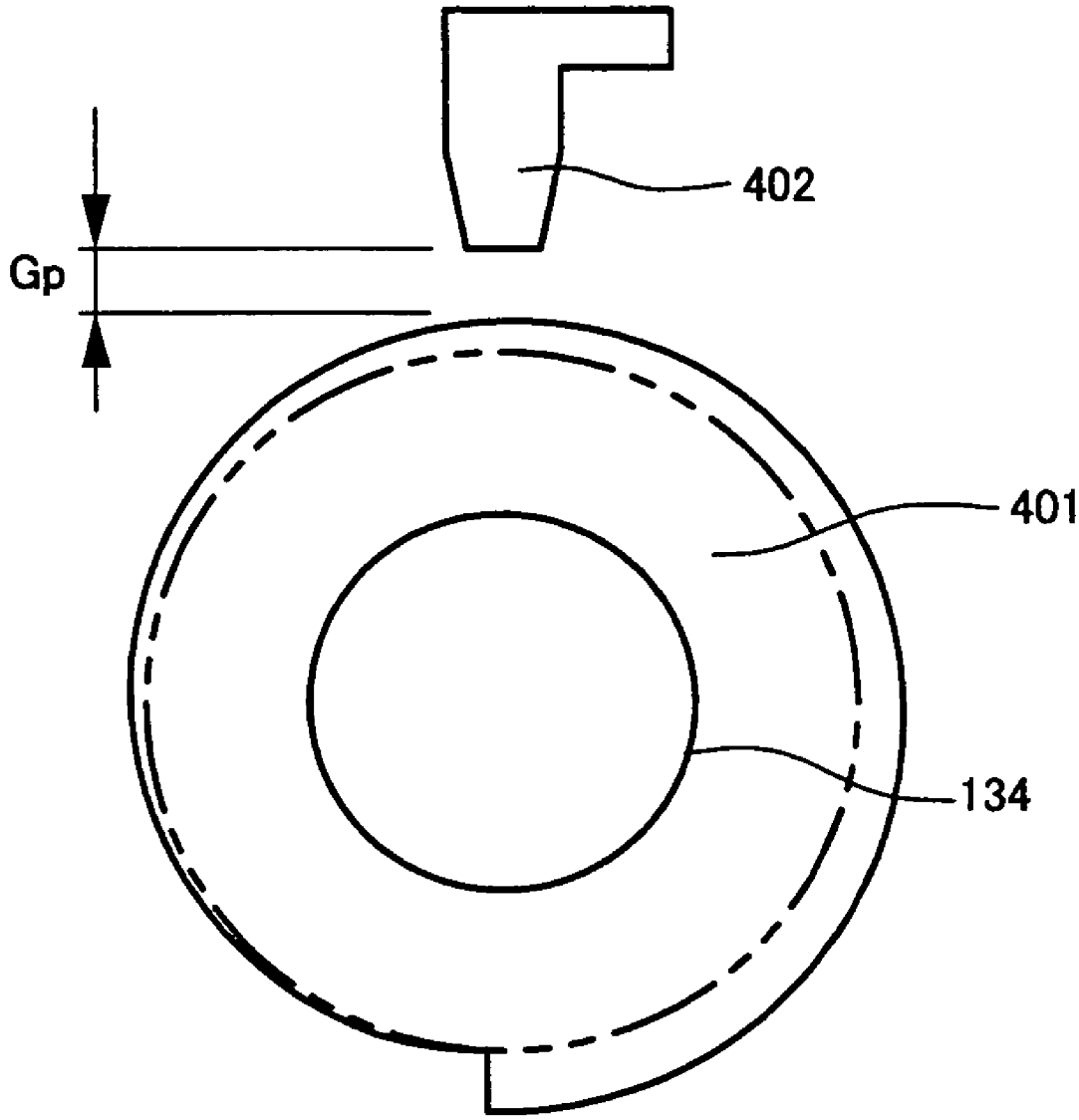
FIG. 24 is a diagram showing a rotator and a gap sensor which are a structure for detecting a rotational position of a camshaft.

For example, as shown in FIG. 24, a rotator 401 rotating along with camshaft 134 and an electromagnetic type gap sensor 402 disposed so as to be close to the outer periphery of rotator 401 are provided, and an actual valve timing of intake valve 105 may be sequentially detected in arbitrary timings on the basis of output signals from gap sensor 402 and crank angle sensor 117.

In this case, rotator 401 is fixed to camshaft 134 directly or indirectly via another member, and the outer periphery thereof is formed such that a distance from the center of camshaft 134 is gradually varied in the circumferential direction.

Gap sensor 402 outputs an output signal (a voltage or the like) corresponding to a gap Gp between camshaft 134 and the outer periphery of rotator 401 varying in accordance with a rotation to ECU 114.

Here, any of fixing methods, fixed positions, and the like thereof in which rotator 401 is provided so as to rotate along with camshaft 134 can be used, and any of systems thereof in which gap sensor 402 can sequentially output a signal corresponding to the gap Gp with the outer periphery of rotator 401 can be used.

Figure 25:
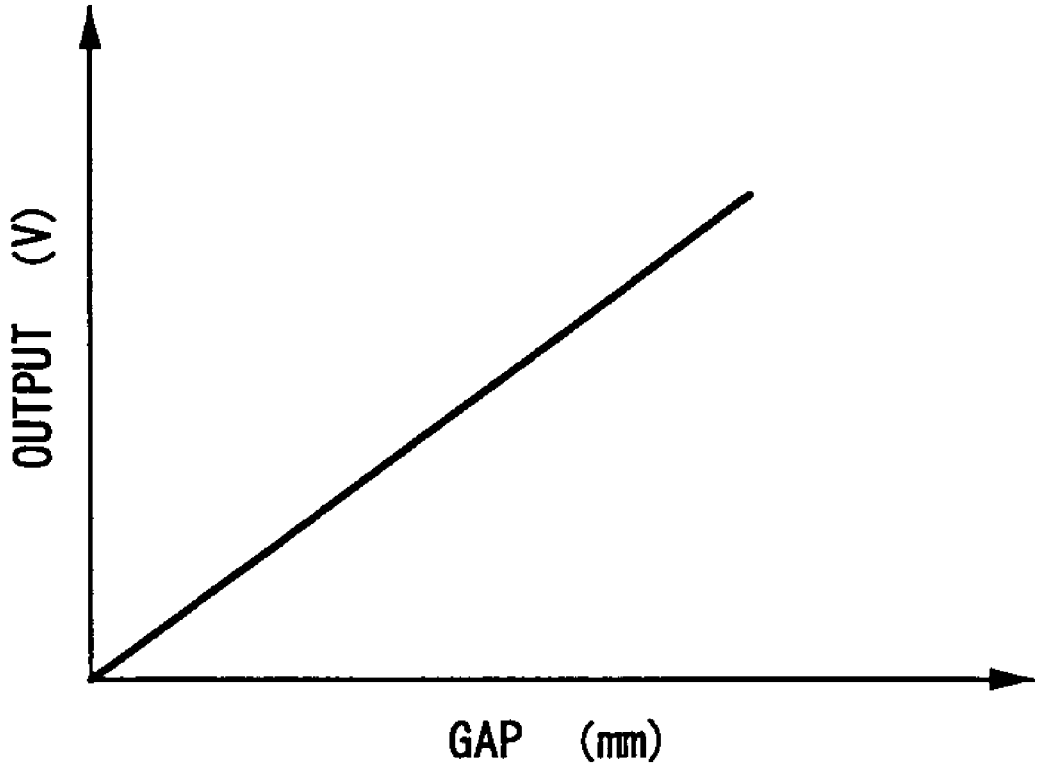
FIG. 25 is a graph showing a relationship between a gap and an output of the gap sensor.
Figure 26:
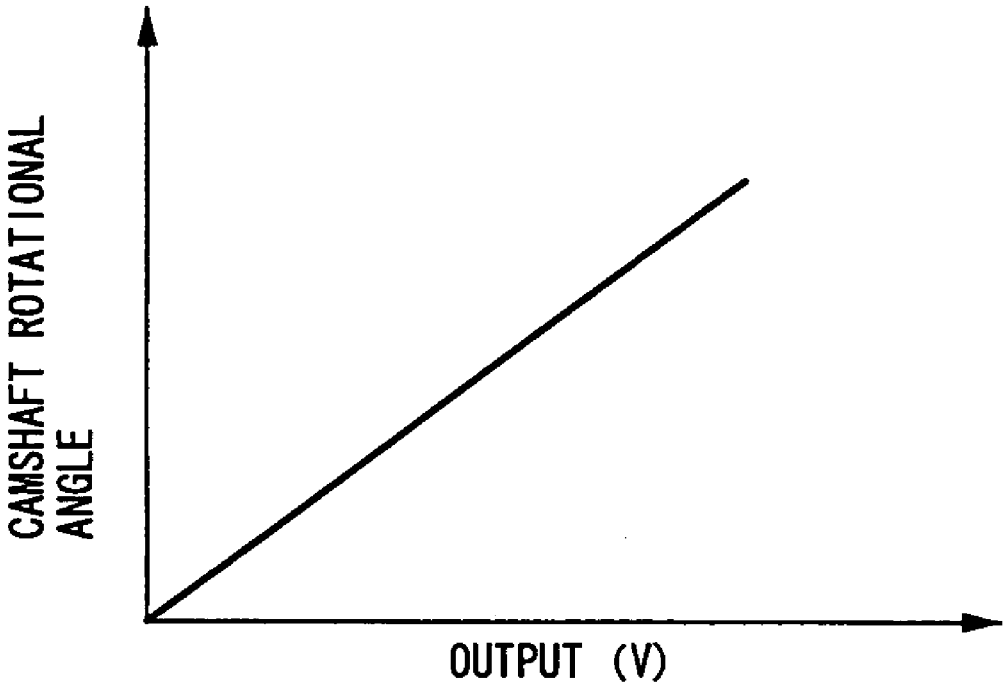
FIG. 26 is a graph showing a relationship between an output of the gap sensor and a rotational angle of the camshaft (rotator).

As shown in FIG. 25, the output from gap sensor 402 is substantially in direct proportion to the gap Gp with the outer periphery of rotator 401, and because the gap Gp and the rotational angle of camshaft 134 correspond to one another in proportion of 1:1, as shown in FIG. 26, the output from gap sensor 402 and the rotational angle of camshaft 134 are substantially in direct proportion.

Namely, ECU 114 can detect the rotational angle of camshaft 134 instantly (in an arbitrary timing) on the basis of an output signal from gap sensor 402.

On the other hand, because the rotational angle of crankshaft 120 can be detected by counting the number of generating unit angle signals POS from a reference rotational position of crankshaft 120 detected at crank angle sensor 117, the rotational phase of camshaft 134 with respect to crankshaft 120 can be detected in an arbitrary timing on the basis of the rotational angle of camshaft 134 and the rotational angle of crankshaft 120 which have been detected.

Note that it may be structured such that a rotator in which a distance from the center is gradually varied in the circumferential direction and a gap sensor are provided at the side of crankshaft 120, and a rotational phase is detected on the basis of output signals from the gap sensor and gap sensor 402 at the side of camshaft 134.

In the above-described structure as well, because the correction table for correcting the second rotational phase θdet2 (correction value) is modified in accordance with a change in the output characteristics or the like of gap sensor 402, by correcting the second rotational phase (detected value) θdet2 by using this correction table, and by executing valve timing control on the basis of the corrected value (θdet2N), the precise of valve timing control, in particular, at the time of low-speed rotating can be highly maintained.

In the embodiments described above, the apparatus in which VTC 113 is provided at intake valve 115 was described. However, a case in which VTC 113 is provided at the side of exhaust valve 107 is in the same way.

Further, if the second rotational phase detecting means can detect a rotational phase of intake side camshaft 134 with respect to crankshaft 120 in an arbitrary timing, it is not limited to the second rotational phase detecting means described above, and any means which can detect a rotational phase at a period which is at least shorter than the rotational period of intake side camshaft 134 may be used as the second rotational phase detecting means.

Moreover, the electromagnetic VTC was described in the above descriptions, the embodiment may be applied to a hydraulic VTC.

The entire contents of basic Japanese Patent Application No. 2004-80514, filed Mar. 19, 2004, Japanese Patent Application NO. 2005-036150, filed Feb. 14, 2005, priorities of which are claimed, are incorporated herein by reference.

We claim:

1. A valve timing control apparatus for an internal combustion engine comprising:

a variable valve timing mechanism which varies an opening-and-closing timing of an intake valve or an exhaust valve due to a rotational phase of a camshaft with respect to a crankshaft of an engine being varied;

a crank angle sensor which detects a reference rotational position of said crankshaft;

a cam sensor which detects a reference rotational position of said camshaft;

a first rotational phase detecting unit which detects said rotational phase at each rotational period of said camshaft on the basis of output signals from said crank angle sensor and said cam sensor;

a second rotational phase detecting unit which can detect said rotational phase in an arbitrary timing regardless of the rotational period of said camshaft; and a correcting unit which corrects the rotational phase detected by said second rotational phase detecting unit with the rotational phase detected by said first rotational phase detecting unit.

2. A valve timing control apparatus for an internal combustion engine according to claim 1, wherein said correcting unit learns a correction value for correcting the rotational phase detected by said second rotational phase detecting unit with the rotational phase detected by said first rotational phase detecting unit as a reference.

3. A valve timing control apparatus for an internal combustion engine according to claim 2, wherein said correcting unit carries out said learning of correction value when a variation per a predetermined time in a rotational phase detected by at least one of said first rotational phase detecting means and said second rotational phase detecting means is less than or equal to a predetermined amount.

4. A valve timing control apparatus for an internal combustion engine according to claim 2 further comprising a temperature sensor which detects an engine temperature, wherein said correcting unit carries out said learning of correction value when an engine temperature is within a predetermined range.

5. A valve timing control apparatus for an internal combustion engine according to claim 1, wherein said second rotational phase detecting unit directly detects said rotational phase without detecting rotational angles of said crankshaft and said camshaft.

6. A valve timing control apparatus for an internal combustion engine according to claim 5, wherein said second rotational phase detecting unit comprises a permanent magnet provided at one of said crankshaft and said camshaft, and a yoke member which is provided at the other of said crankshaft and said camshaft, and which is formed such that a magnetic flux density of a magnetic field from a center of a magnetic pole of said permanent magnet is varied in accordance with a relative rotation of said crankshaft and said camshaft, and detects said rotational phase on the basis of a variation in said magnetic flux density.

7. A valve timing control apparatus for an internal combustion engine according to claim 6, wherein said second rotational phase detecting unit comprises a Hall element which detects a variation in said magnetic flux density.

8. A valve timing control apparatus for an internal combustion engine according to claim 1, wherein said second rotational phase detecting unit comprises a first rotational angle sensor which detects a rotational angle of said crankshaft, and a second rotational angle sensor which can detect a rotational angle of said camshaft in an arbitrary timing, and detects said rotational phase on the basis of output signals from said first rotational angle sensor and said second rotational angle sensor.

9. A valve timing control apparatus for an internal combustion engine according to claim 8 further comprising a rotator which rotates along with said camshaft, and in which a distance from a center of the camshaft to an outer periphery thereof varies in a circumferential direction, wherein said second rotational angle sensor detects a rotational angle of said camshaft in accordance with a gap formed between the outer periphery of said rotator.

10. A valve timing control apparatus for an internal combustion engine according to claim 1 further comprising:

a rotational speed sensor which detects an engine rotational speed; and a control unit which controls said variable valve timing mechanism on the basis of the rotational phase detected by said first rotational phase detecting means when an engine rotational speed is greater than or equal to a predetermined rotational speed set in advance, and on the other hand, which controls said variable valve timing mechanism on the basis of the rotational phase detected by said second rotational phase detecting means when an engine rotational speed is less than said predetermined rotational speed.

11. A valve timing control apparatus for an internal combustion engine comprising:

a variable valve timing mechanism which varies an opening-and-closing timing of an intake valve or an exhaust valve due to a rotational phase of a camshaft with respect to a crankshaft of an engine being varied;

a crank angle sensor which detects a reference rotational position of said crankshaft;

a cam sensor which detects a reference rotational position of said camshaft;

first rotational phase detecting means for detecting said rotational phase at each rotational period of said camshaft on the basis of output signals from said crank angle sensor and said cam sensor;

second rotational phase detecting means for being able to detect said rotational phase in an arbitrary timing regardless of the rotational period of said camshaft; and correcting means for correcting the rotational phase detected by said second rotational phase detecting means with the rotational phase detected by said first rotational phase detecting means.

12. A valve timing control method for an internal combustion engine which varies an opening-and-closing timing of an intake valve or an exhaust valve due to a rotational phase of a camshaft with respect to a crankshaft of an internal combustion engine being varied comprising the steps of:

detecting a reference rotational position of said crankshaft and a reference rotational position of said camshaft;

detecting said rotational phase at each rotational period of said camshaft on the basis of the reference rotational position of said crankshaft and the reference rotational position of said camshaft;

detecting said rotational phase in an arbitrary timing regardless of the rotational period of said camshaft; and correcting the rotational phase detected in said arbitrary timing with the rotational phase detected at each rotational period of said camshaft as a reference.

13. A control method according to claim 12, wherein learning a correction value for correcting the rotational phase detected in said arbitrary timing with the rotational phase detected at each rotational period of said camshaft as a reference.

14. A control method according to claim 13, wherein said learning of correction value is carried out when a variation per a predetermined time in at least one of the rotational phase detected at each rotational period of said camshaft and the rotational phase detected in said arbitrary timing is less than or equal to a predetermined amount.

15. A control method according to claim 13 further comprising a step of detecting an engine temperature, wherein said learning of correction value is carried out when said engine temperature is within a predetermined range.

16. A control method according to claim 12, wherein the step of detecting the rotational phase in said arbitrary timing directly detects said rotational phase without detecting rotational angles of said crankshaft and said camshaft.

17. A control method according to claim 16, wherein the step of detecting the rotational phase in said arbitrary timing detects a variation in a magnetic flux density of a magnetic field from a center of a magnetic pole of a permanent magnet provided at one of said crankshaft and said camshaft which relatively rotate toward a yoke member provided at the other one of said crankshaft and said camshaft, and detects said rotational phase on the basis of the detected variation in the magnetic flux density.

18. A control method according to claim 17, wherein a variation in said magnetic flux density is detected by a Hall element.

19. A control method according to claim 12, wherein the step of detecting the rotational phase in said arbitrary timing detects a rotational angle of said crankshaft and a rotational angle of said camshaft; and detects said rotational phase on the basis of the rotational angle of said crankshaft and the rotational angle of said camshaft which were detected.

20. A control method according to claim 19, wherein a variation in a gap between an outer periphery of an rotator rotating along with said camshaft is detected, and a rotational position of said camshaft is detected on the basis of a detected variation in the gap.

21. A control method according to claim 12 further comprising the steps of:

detecting an engine rotational speed; and controlling said opening-and-closing timing on the basis of the rotational phase detected at each rotational period of said camshaft when an engine rotational speed is greater than or equal to a predetermined rotational speed set in advance, and on the other hand, controlling said opening-and-closing timing on the basis of the rotational phase detected in said arbitrary timing when an engine rotational speed is less than said predetermined rotational speed.

* * * * *